US008727207B1

(12) United States Patent
Church et al.

(10) Patent No.: US 8,727,207 B1
(45) Date of Patent: May 20, 2014

(54) ELECTRONIC PARKING METER

(75) Inventors: Donald W. Church, Halifax (CA); Douglas George Pincock, Halifax (CA); Theodore Gerard Bushnik, Dartmouth (CA); John Roderick Campbell, Dartmouth (CA); Gregory Emile Chauvin, Hatchett Lake (CA)

(73) Assignee: J.J. MacKay Canada Limited (CA)

( * ) Notice: Subject to any disclaimer, the term of this patent is extended or adjusted under 35 U.S.C. 154(b) by 0 days.

(21) Appl. No.: 08/959,109

(22) Filed: Oct. 23, 1997

Related U.S. Application Data

(63) Continuation of application No. 08/418,018, filed on Apr. 6, 1995, now abandoned.

(51) Int. Cl.
*G07B 15/00* (2011.01)

(52) U.S. Cl.
USPC ..... 235/33; 235/384; 235/375

(58) Field of Classification Search
USPC ..... 235/375, 380, 384, 33, 91 R; 200/DIG. 3; 194/317–319, 900; 324/225, 227, 236, 23
See application file for complete search history.

(56) References Cited

U.S. PATENT DOCUMENTS

| | | | | |
|---|---|---|---|---|
| 1,189,991 | A | 7/1916 | Mugler | 70/120 |
| D107,577 | S | 12/1937 | McGay | D10/42 |
| 2,161,046 | A | 6/1939 | Hitzeman | 194/205 |
| 2,261,353 | A | 11/1941 | Gaetano | 70/120 |
| 2,289,838 | A | 7/1942 | Herschede et al. | 194/226 |
| D152,294 | S | 1/1949 | Siegel et al. | D20/10 |
| 2,546,433 | A | 3/1951 | Dick | 368/6 |
| 2,547,272 | A | 4/1951 | Lawson et al. | 116/282 |
| D166,059 | S | 2/1952 | Yoss | D10/42 |
| D166,753 | S | 5/1952 | Jones | D10/42 |
| 2,599,881 | A | 6/1952 | Woodruff | 368/92 |
| D181,359 | S | 11/1957 | Jones | D10/42 |
| 2,832,506 | A | 4/1958 | Hatcher | 221/103 |
| 2,956,525 | A | 10/1960 | Blauvelt | 109/59 |
| 2,985,978 | A | 5/1961 | Breen et al. | 40/333 |
| 2,988,191 | A | 6/1961 | Grant | 194/1 |
| 3,056,544 | A | 10/1962 | Sollenberger et al. | 232/16 |
| 3,204,438 | A | 9/1965 | Sollenberger | 70/417 |
| 3,208,061 | A | 9/1965 | Gervasi et al. | 340/539.31 |
| 3,373,856 | A | 3/1968 | Kusters et al. | 194/100 |
| 3,486,324 | A | 12/1969 | Andersson | 368/90 |
| 3,637,277 | A | 1/1972 | Krug et al. | 312/217 |

(Continued)

FOREIGN PATENT DOCUMENTS

| | | | |
|---|---|---|---|
| AU | 4035701 | 9/2001 | G07F 17/24 |
| CA | 2233931 | 4/1997 | G08G 1/14 |

(Continued)

OTHER PUBLICATIONS

U.S. Appl. No. 13/141,977, filed Jun. 23, 2011.

(Continued)

*Primary Examiner* — Karl D Frech
(74) *Attorney, Agent, or Firm* — Hayes Soloway P.C.

(57) ABSTRACT

A proximity detector for detecting the presence of a coin or token in a coin chute, comprising a pair of axially aligned coils disposed on opposed sides of the chute; a common-emitter amplifier having a base and a collector providing a detector output, one of the coils being connected to the collector and the other of the coils being connected to the base.

51 Claims, 24 Drawing Sheets

(56) References Cited

U.S. PATENT DOCUMENTS

| | | | | | |
|---|---|---|---|---|---|
| 3,941,989 | A | | 3/1976 | McLaughlin et al. | 235/156 |
| 3,975,934 | A | | 8/1976 | Babai et al. | 70/120 |
| 3,982,620 | A | | 9/1976 | Kortenhaus | 194/1 N |
| 3,991,595 | A | | 11/1976 | Bahry et al. | 70/120 |
| 3,999,372 | A | | 12/1976 | Welch et al. | 58/142 |
| 4,237,710 | A | | 12/1980 | Cardozo | 70/108 |
| 4,249,648 | A | | 2/1981 | Meyer | 194/102 |
| 4,264,963 | A | | 4/1981 | Leach | 364/707 |
| 4,306,219 | A | | 12/1981 | Main et al. | 340/825.54 |
| 4,317,180 | A | | 2/1982 | Lies | 364/707 |
| 4,317,181 | A | | 2/1982 | Teza et al. | 364/707 |
| 4,323,847 | A | * | 4/1982 | Karbowski | 324/327 |
| 4,409,665 | A | | 10/1983 | Tubbs | 364/707 |
| 4,432,447 | A | | 2/1984 | Tanaka | 194/100 |
| 4,460,080 | A | | 7/1984 | Howard | 194/100 A |
| 4,474,281 | A | | 10/1984 | Roberts et al. | 194/1 N |
| 4,479,191 | A | | 10/1984 | Nojima et al. | 364/707 |
| 4,483,431 | A | | 11/1984 | Pratt | 194/97 |
| 4,574,936 | A | * | 3/1986 | Klinger | 194/318 |
| 4,639,021 | A | | 1/1987 | Hope | 292/7 |
| 4,678,994 | A | * | 7/1987 | Davies | 324/236 |
| 4,742,903 | A | | 5/1988 | Trummer | 194/317 |
| 4,749,074 | A | | 6/1988 | Ueki et al. | 194/317 |
| D296,795 | S | | 7/1988 | Bouve | D20/10 |
| 4,763,769 | A | | 8/1988 | Levasseur | 194/217 |
| 4,809,838 | A | | 3/1989 | Houserman | 194/317 |
| 4,812,805 | A | | 3/1989 | Lachat et al. | 340/825.05 |
| 4,823,928 | A | | 4/1989 | Speas | |
| 4,825,425 | A | | 4/1989 | Turner | 368/7 |
| 4,827,206 | A | | 5/1989 | Speas | 323/299 |
| 4,845,484 | A | | 7/1989 | Ellsberg | 340/825.35 |
| 4,848,556 | A | | 7/1989 | Shah et al. | 194/212 |
| 4,851,987 | A | | 7/1989 | Day | 364/200 |
| 4,872,149 | A | | 10/1989 | Speas | 368/90 |
| 4,875,598 | A | | 10/1989 | Dahl | 221/4 |
| 4,880,097 | A | | 11/1989 | Speas | 194/239 |
| 4,895,238 | A | | 1/1990 | Speas | 194/319 |
| 4,951,799 | A | | 8/1990 | Kai | 194/317 |
| 4,967,895 | A | | 11/1990 | Speas | 194/200 |
| 4,976,630 | A | | 12/1990 | Schuder et al. | 439/260 |
| 4,989,714 | A | | 2/1991 | Abe | 194/317 |
| 5,027,935 | A | * | 7/1991 | Berg et al. | 194/318 |
| 5,060,777 | A | | 10/1991 | Van Horn et al. | 194/317 |
| 5,065,156 | A | | 11/1991 | Bernier | 340/932.2 |
| 5,076,414 | A | | 12/1991 | Kimoto | 194/317 |
| 5,109,972 | A | | 5/1992 | Van Horn et al. | 194/217 |
| 5,119,916 | A | | 6/1992 | Carmen et al. | 194/210 |
| 5,155,614 | A | | 10/1992 | Carmen et al. | 398/202 |
| 5,158,166 | A | * | 10/1992 | Barson | 194/319 |
| 5,222,076 | A | | 6/1993 | Ng et al. | 375/9 |
| 5,244,070 | A | | 9/1993 | Carmen et al. | 194/319 |
| D340,038 | S | | 10/1993 | Venne et al. | D14/420 |
| 5,259,491 | A | | 11/1993 | Ward II | 194/350 |
| 5,266,947 | A | | 11/1993 | Fujiwara et al. | 340/932.2 |
| 5,273,151 | A | | 12/1993 | Carmen et al. | 194/319 |
| 5,287,384 | A | | 2/1994 | Avery et al. | 375/1 |
| 5,293,979 | A | * | 3/1994 | Levasseur | 194/317 |
| 5,343,237 | A | | 8/1994 | Morimoto | 348/143 |
| 5,351,798 | A | * | 10/1994 | Hayes | 194/318 |
| 5,360,095 | A | | 11/1994 | Speas | 194/217 |
| 5,402,475 | A | | 3/1995 | Lesner, Jr. et al. | 379/106 |
| 5,407,049 | A | * | 4/1995 | Jacobs | 194/200 |
| 5,439,089 | A | * | 8/1995 | Parker | 194/317 |
| 5,442,348 | A | | 8/1995 | Mushell | 340/932.2 |
| 5,454,461 | A | * | 10/1995 | Jacobs | 194/200 |
| 5,475,373 | A | | 12/1995 | Speas | 340/815.58 |
| 5,489,014 | A | * | 2/1996 | Menoud | 194/211 |
| 5,500,517 | A | * | 3/1996 | Cagliostro | 235/486 |
| 5,563,491 | A | | 10/1996 | Tseng | 320/2 |
| 5,568,441 | A | | 10/1996 | Sanemitsu | 365/229 |
| 5,614,892 | A | | 3/1997 | Ward, II et al. | 340/870.02 |
| 5,617,942 | A | | 4/1997 | Ward, II et al. | 194/217 |
| 5,642,119 | A | | 6/1997 | Jacobs | 342/69 |
| 5,648,906 | A | | 7/1997 | Amirpanahi | 705/418 |
| D381,976 | S | | 8/1997 | Sandor et al. | D14/420 |
| 5,659,306 | A | | 8/1997 | Bahar | 340/932.2 |
| 5,687,129 | A | | 11/1997 | Kim | 365/229 |
| 5,710,743 | A | | 1/1998 | Dee et al. | 368/90 |
| D391,238 | S | | 2/1998 | Sakata | D14/420 |
| 5,740,050 | A | | 4/1998 | Ward, II | 364/464.28 |
| 5,748,103 | A | | 5/1998 | Flach et al. | 340/870.07 |
| 5,761,061 | A | | 6/1998 | Amano | 364/187 |
| 5,777,951 | A | | 7/1998 | Mitschele et al. | 368/90 |
| 5,805,083 | A | | 9/1998 | Sutton et al. | 340/932.2 |
| 5,806,651 | A | | 9/1998 | Carmen et al. | 194/319 |
| 5,833,042 | A | | 11/1998 | Baitch et al. | 194/317 |
| 5,841,369 | A | | 11/1998 | Sutton et al. | 340/932.2 |
| 5,845,268 | A | | 12/1998 | Moore | 705/418 |
| 5,852,411 | A | | 12/1998 | Jacobs et al. | 340/932.2 |
| D404,025 | S | | 1/1999 | Van Horne et al. | D14/331 |
| 5,903,520 | A | | 5/1999 | Dee et al. | 368/90 |
| 5,911,763 | A | | 6/1999 | Quesada | 70/120 |
| D413,311 | S | | 8/1999 | Blalock | D14/420 |
| 5,954,182 | A | | 9/1999 | Wei | 194/345 |
| 5,966,345 | A | | 10/1999 | Dee et al. | 368/90 |
| 6,037,880 | A | | 3/2000 | Manion | 340/932.2 |
| 6,052,453 | A | | 4/2000 | Sagady et al. | 379/146 |
| 6,081,206 | A | | 6/2000 | Kielland | 340/937 |
| 6,082,153 | A | | 7/2000 | Schoell et al. | 70/1.5 |
| 6,107,942 | A | | 8/2000 | Yoo et al. | 340/932.2 |
| 6,111,522 | A | | 8/2000 | Hiltz et al. | 340/932.2 |
| 6,116,403 | A | | 9/2000 | Kiehl | 194/217 |
| 6,147,624 | A | | 11/2000 | Clapper | 340/932.2 |
| 6,195,015 | B1 | | 2/2001 | Jacobs et al. | 340/693.9 |
| RE37,193 | E | | 5/2001 | Ward et al. | 194/217 |
| 6,229,455 | B1 | | 5/2001 | Yost et al. | 340/943 |
| 6,230,868 | B1 | | 5/2001 | Tuxen et al. | 194/217 |
| 6,243,029 | B1 | | 6/2001 | Tomer | 340/932.2 |
| 6,275,170 | B1 | | 8/2001 | Jacobs et al. | 340/932.2 |
| D448,910 | S | | 10/2001 | Kit et al. | D99/28 |
| 6,309,098 | B1 | | 10/2001 | Wong | 368/94 |
| 6,312,152 | B2 | | 11/2001 | Dee et al. | 368/90 |
| 6,340,935 | B1 | | 1/2002 | Hall | 340/932.2 |
| 6,354,425 | B1 | | 3/2002 | Tuxen et al. | 194/350 |
| 6,373,442 | B1 | | 4/2002 | Thomas et al. | 343/767 |
| D461,728 | S | | 8/2002 | Tuxen et al. | D10/42 |
| 6,456,491 | B1 | | 9/2002 | Flannery et al. | 361/685 |
| 6,457,586 | B2 | | 10/2002 | Yasuda et al. | 209/534 |
| 6,477,875 | B2 | | 11/2002 | Field et al. | 70/191 |
| 6,505,774 | B1 | | 1/2003 | Fulcher et al. | |
| 6,747,575 | B2 | | 6/2004 | Chauvin et al. | 340/932.2 |
| 6,791,473 | B2 | | 9/2004 | Kibria et al. | 340/932.2 |
| D497,393 | S | | 10/2004 | Herbst | D20/99 |
| 6,799,387 | B2 | | 10/2004 | Pippins | 37/456 |
| 6,823,317 | B1 | | 11/2004 | Ouimet et al. | 705/13 |
| 6,856,922 | B1 | | 2/2005 | Austin et al. | 702/63 |
| 6,874,340 | B1 | | 4/2005 | Berman | 7/161 |
| 6,889,899 | B2 | | 5/2005 | Silberberg | 235/384 |
| 6,914,411 | B2 | | 7/2005 | Couch et al. | 320/101 |
| 6,929,179 | B2 | | 8/2005 | Fulcher et al. | 235/381 |
| 7,014,355 | B2 | | 3/2006 | Potter, Sr. et al. | 368/90 |
| 7,019,420 | B2 | | 3/2006 | Kogan et al. | 307/150 |
| 7,027,773 | B1 | | 4/2006 | McMillin | 455/41.2 |
| 7,029,167 | B1 | | 4/2006 | Mitschele | 368/90 |
| 7,071,839 | B2 | | 7/2006 | Patel et al. | 340/933 |
| 7,104,447 | B1 | | 9/2006 | Lopez et al. | 235/384 |
| 7,183,999 | B2 | | 2/2007 | Matthews et al. | 345/1.1 |
| 7,222,031 | B2 | | 5/2007 | Heatley | |
| 7,237,716 | B2 | | 7/2007 | Silberberg | 235/384 |
| 7,253,747 | B2 | | 8/2007 | Noguchi | 340/932.2 |
| 7,319,974 | B1 | | 1/2008 | Brusseaux | 705/13 |
| 7,330,131 | B2 | | 2/2008 | Zanotti et al. | 340/932.2 |
| 7,382,238 | B2 | | 6/2008 | Kavaler | 340/438 |
| 7,382,281 | B2 | | 6/2008 | Kavaler | 340/941 |
| 7,382,282 | B2 | | 6/2008 | Kavaler | 340/941 |
| 7,388,349 | B2 | | 6/2008 | Elder et al. | 320/104 |
| 7,388,517 | B2 | | 6/2008 | Kavaler | 340/941 |
| 7,393,134 | B2 | | 7/2008 | Mitschele | 368/90 |
| D575,168 | S | | 8/2008 | King et al. | D10/42 |
| 7,427,931 | B1 | | 9/2008 | Kavaler et al. | 340/941 |
| D587,141 | S | | 2/2009 | King et al. | D10/42 |
| D602,225 | S | | 10/2009 | Lute et al. | D99/28 |
| D615,274 | S | | 5/2010 | Kim et al. | D99/28 |
| D617,799 | S | | 6/2010 | Odhe et al. | D14/420 |

(56) References Cited

U.S. PATENT DOCUMENTS

| | | | | |
|---|---|---|---|---|
| 7,739,000 | B2 | 6/2010 | Kevaler | 701/1 |
| 7,748,620 | B2 | 7/2010 | Gomez et al. | 235/383 |
| 7,772,720 | B2 | 8/2010 | McGee et al. | 307/66 |
| 7,806,248 | B2 | 10/2010 | Hunter et al. | 194/317 |
| 7,854,310 | B2 | 12/2010 | King et al. | 194/350 |
| 7,855,661 | B2 | 12/2010 | Ponert | 340/932.2 |
| 7,874,482 | B2 | 1/2011 | Mitschele | 235/384 |
| 7,933,841 | B2 | 4/2011 | Schmeyer et al. | 705/64 |
| 8,035,533 | B2 | 10/2011 | Kavaler | 340/933 |
| D652,329 | S | 1/2012 | MacKay et al. | D10/42 |
| D654,816 | S | 2/2012 | MacKay et al. | D10/42 |
| 8,144,034 | B2 | 3/2012 | Kavaler | 340/941 |
| 8,184,019 | B2 | 5/2012 | Chauvin et al. | 340/932.2 |
| 8,264,401 | B1 | 9/2012 | Kavaler | 342/128 |
| 2001/0012241 | A1 | 8/2001 | Dee et al. | 368/90 |
| 2001/0047278 | A1 | 11/2001 | Brookner et al. | 705/1 |
| 2001/0051531 | A1 | 12/2001 | Singhal et al. | 455/556 |
| 2002/0030606 | A1 | 3/2002 | Chauvin et al. | 340/932.2 |
| 2002/0062172 | A1 | 5/2002 | Bench et al. | 700/232 |
| 2002/0134645 | A1 | 9/2002 | Alexander et al. | 194/351 |
| 2003/0092387 | A1 | 5/2003 | Hjelmvik | 455/41 |
| 2003/0112151 | A1 | 6/2003 | Chauvin et al. | 340/870.02 |
| 2003/0112597 | A1 | 6/2003 | Smith | 361/685 |
| 2003/0117904 | A1 | 6/2003 | Lank et al. | |
| 2003/0121754 | A1 | 7/2003 | King | 194/302 |
| 2003/0128010 | A1 | 7/2003 | Hsu | 320/101 |
| 2003/0128136 | A1 | 7/2003 | Spier et al. | 340/932.2 |
| 2003/0140531 | A1 | 7/2003 | Pippins | 37/456 |
| 2003/0144972 | A1 | 7/2003 | Cordery et al. | 705/401 |
| 2003/0179107 | A1 | 9/2003 | Kibria et al. | 340/932.2 |
| 2003/0222792 | A1 | 12/2003 | Berman et al. | 340/932.2 |
| 2004/0011099 | A1 | 1/2004 | Andersson | 70/371 |
| 2004/0039632 | A1 | 2/2004 | Han et al. | 705/13 |
| 2004/0068434 | A1 | 4/2004 | Kanekon | |
| 2004/0084278 | A1 | 5/2004 | Harris et al. | 194/302 |
| 2004/0181496 | A1 | 9/2004 | Odinotski et al. | 705/418 |
| 2004/0232878 | A1 | 11/2004 | Couch et al. | 320/101 |
| 2004/0243526 | A1 | 12/2004 | Krygler et al. | 705/418 |
| 2004/0263117 | A1 | 12/2004 | Kogan et al. | 320/114 |
| 2004/0264302 | A1 | 12/2004 | Ward, II | 368/90 |
| 2005/0035740 | A1 | 2/2005 | Elder et al. | 320/116 |
| 2005/0155839 | A1 | 7/2005 | Banks et al. | 194/302 |
| 2005/0178639 | A1 | 8/2005 | Brumfield et al. | 194/350 |
| 2005/0192911 | A1 | 9/2005 | Mattern | 705/401 |
| 2006/0021848 | A1 | 2/2006 | Smith | 194/350 |
| 2006/0114159 | A1 | 6/2006 | Yoshikawa et al. | |
| 2006/0116972 | A1 | 6/2006 | Wong | 705/418 |
| 2006/0136131 | A1 | 6/2006 | Dugan et al. | 701/300 |
| 2006/0149684 | A1 | 7/2006 | Matsuura et al. | 705/65 |
| 2006/0152349 | A1 | 7/2006 | Ratnakar | 340/426 |
| 2006/0152385 | A1 | 7/2006 | Mandy | 340/932.2 |
| 2006/0267799 | A1 | 11/2006 | Mendelson | 340/932.2 |
| 2007/0016539 | A1 | 1/2007 | Groft et al. | 705/418 |
| 2007/0017265 | A1 | 1/2007 | Andersson | 70/379 |
| 2007/0044523 | A1 | 3/2007 | Davis | 70/34 |
| 2007/0094153 | A1 | 4/2007 | Ferraro | 705/67 |
| 2007/0114849 | A1 | 5/2007 | Falik et al. | 307/64 |
| 2007/0119682 | A1 | 5/2007 | Banks et al. | 705/418 |
| 2007/0136128 | A1 | 6/2007 | Janacek et al. | 705/13 |
| 2007/0171069 | A1 | 7/2007 | Allen | 340/572.1 |
| 2007/0208499 | A1 | 9/2007 | Kwong | 701/117 |
| 2008/0071611 | A1 | 3/2008 | Lovett | 705/13 |
| 2008/0093454 | A1 | 4/2008 | Yamazaki et al. | |
| 2008/0158010 | A1 | 7/2008 | Nath et al. | 340/932.2 |
| 2008/0165030 | A1 | 7/2008 | Kuo et al. | 340/932.2 |
| 2008/0208680 | A1 | 8/2008 | Cho | 705/13 |
| 2008/0238715 | A1 | 10/2008 | Cheng et al. | 340/870.03 |
| 2008/0245638 | A1 | 10/2008 | King et al. | 194/350 |
| 2008/0266138 | A1 | 10/2008 | Ponert | 340/932.2 |
| 2008/0277468 | A1 | 11/2008 | Mitschele | 235/384 |
| 2008/0291054 | A1 | 11/2008 | Groft | 340/932.2 |
| 2009/0026842 | A1 | 1/2009 | Hunter et al. | 307/66 |
| 2009/0032368 | A1 | 2/2009 | Hunter et al. | 194/318 |
| 2009/0049875 | A1 | 2/2009 | Buhl et al. | 70/52 |
| 2009/0095593 | A1 | 4/2009 | King et al. | 194/302 |
| 2009/0102726 | A1 | 4/2009 | Imano et al. | |
| 2009/0109062 | A1 | 4/2009 | An | 340/932.2 |
| 2009/0159674 | A1 | 6/2009 | King et al. | 235/382 |
| 2009/0183966 | A1 | 7/2009 | King et al. | 194/217 |
| 2009/0192950 | A1 | 7/2009 | King et al. | 705/418 |
| 2009/0199966 | A1 | 8/2009 | Coleman et al. | |
| 2009/0254438 | A1 | 10/2009 | Johnson, Jr. et al. | 705/17 |
| 2009/0284907 | A1 | 11/2009 | Regimbal et al. | 361/679.02 |
| 2010/0019936 | A1 | 1/2010 | Kaveler | 340/933 |
| 2010/0026522 | A1 | 2/2010 | Ward, II | 340/932.2 |
| 2010/0030629 | A1 | 2/2010 | Ward, II | 705/13 |
| 2010/0328104 | A1 | 12/2010 | Groft | 340/932.2 |
| 2011/0037562 | A1 | 2/2011 | Braukmann et al. | |
| 2011/0057815 | A1 | 3/2011 | King et al. | 340/932.2 |
| 2011/0060653 | A1 | 3/2011 | King et al. | 705/14.58 |
| 2011/0066297 | A1 | 3/2011 | Saberi et al. | 700/287 |
| 2011/0093314 | A1 | 4/2011 | Redmann et al. | |
| 2011/0122036 | A1 | 5/2011 | Leung et al. | |
| 2011/0158331 | A1 | 6/2011 | Kavaler et al. | 375/259 |
| 2011/0203901 | A1 | 8/2011 | King et al. | 194/211 |
| 2011/0205087 | A1 | 8/2011 | Kell et al. | 340/932.2 |
| 2011/0221624 | A1 | 9/2011 | Kavaler | 342/22 |
| 2011/0261548 | A1 | 10/2011 | Gandhi | |
| 2011/0320243 | A1 | 12/2011 | Khan | 705/13 |
| 2012/0026015 | A1 | 2/2012 | Kavaler | 340/933 |
| 2012/0173171 | A1 | 7/2012 | Bajwa et al. | 702/56 |
| 2013/0027218 | A1 | 1/2013 | Schwarz et al. | 340/870.02 |

FOREIGN PATENT DOCUMENTS

| | | | | |
|---|---|---|---|---|
| CA | 2260925 | | 1/1998 | G07B 15/00 |
| CA | 2227833 | | 7/1998 | G07F 17/24 |
| CA | 2346908 | | 4/2000 | G07C 1/30 |
| CA | 2352968 | | 1/2001 | G07F 17/24 |
| CA | 2377010 | | 12/2001 | G06F 19/00 |
| CA | 2357179 | | 3/2002 | G08C 17/00 |
| CA | 2437722 | | 8/2002 | G08F 1/14 |
| CA | 2363915 | | 5/2003 | G07F 17/24 |
| CA | 2413198 | | 5/2003 | G07F 17/24 |
| CA | 2414132 | | 6/2003 | G07F 17/24 |
| CN | 239544 | | 9/2000 | G07F 17/24 |
| CN | 2544352 | | 4/2003 | G06F 19/00 |
| DE | 28 04 085 | A1 | 2/1977 | G07C 1/04 |
| DE | 27 50 193 | C2 | 11/1977 | G07F 3/02 |
| EP | 980055 | | 2/2000 | G07F 17/24 |
| EP | 1376491 | | 1/2004 | G07F 7/00 |
| FR | 2837583 | | 9/2003 | G06K 19/077 |
| GB | 1 237 579 | | 12/1968 | G07F 17/24 |
| GB | 1 283 555 | | 10/1969 | G07C 1/02 |
| GB | 1431862 | | 4/1976 | G08B 25/00 |
| GB | 2155228 | | 9/1985 | G09F 23/00 |
| JP | 01165494 | | 6/1989 | B42D 15/10 |
| JP | 01303026 | | 12/1989 | G11C 5/00 |
| JP | 0261711 | | 3/1990 | G06F 1/26 |
| JP | 0487533 | | 3/1992 | H02J 9/00 |
| JP | 2002099640 | | 4/2002 | G06Q 10/00 |
| JP | 2005267430 | | 9/2005 | G06Q 10/00 |
| JP | 2007052773 | | 3/2007 | G07F 17/24 |
| KR | 20050038077 | | 4/2005 | G07B 5/12 |
| MX | 2008007047 | | 8/2008 | G06Q 10/00 |
| WO | WO 81/00778 | | 3/1981 | G07F 17/24 |
| WO | WO9520204 | | 7/1995 | G07F 17/24 |
| WO | WO97/12345 | | 4/1997 | G07F 17/24 |
| WO | WO98/04080 | | 1/1998 | H04M 15/00 |
| WO | WO01/69541 | | 9/2001 | G07F 17/24 |
| WO | WO2006095352 | | 9/2006 | H02J 9/06 |
| WO | WO2007063530 | | 6/2007 | G06Q 10/00 |
| WO | WO2009154787 | | 12/2009 | G08G 1/14 |
| WO | WO2010008610 | | 1/2010 | G08G 1/065 |
| WO | WO2010071974 | | 7/2010 | G07C 1/30 |
| WO | WO2011029061 | | 3/2011 | G06Q 30/00 |
| WO | WO2011029062 | | 3/2011 | G06Q 20/00 |
| WO | WO2012015453 | | 2/2012 | G08G 1/042 |
| WO | WO2012092609 | | 7/2012 | G08G 1/01 |
| WO | WO2013016453 | | 1/2013 | G07B 15/02 |
| WO | WO2013049418 | | 4/2013 | |

(56) References Cited

FOREIGN PATENT DOCUMENTS

OTHER PUBLICATIONS

U.S. Appl. No. 13/141,983, filed Jun. 23, 2011.
U.S. Appl. No. 13/410,831, filed Mar. 2, 2012.
U.S. Appl. No. 13/529,914, filed Jun. 21, 2012.
U.S. Appl. No. 13/545,871, filed Jul. 10, 2012.
U.S. Appl. No. 13/546,918, filed Jul. 11, 2012.
U.S. Appl. No. 29/433,549, filed Oct. 1, 2012.
U.S. Appl. No. 13,141/977, filed Jun. 23, 2011, MacKay et al.
U.S. Appl. No. 13/454,976, filed Apr. 24, 2012, Chauvin et al.
POM APM Solar Powered meter advertisements, undated (5 pgs).
Byrd, Dennis, "City officials plug solar-powered parking meters, Electronic eye ends free parking," Lawrence Journal World, Apr. 30, 1989, p. 11C (1pg).
Byrd, Dennis, Parking Meter Manufacturer Sees Bright Future for New Sun-Powered Devices, Los Angeles Times, May 14, 1989 (2 pgs).
International Search Report, PCT/CA2009/001058, dated Nov. 12, 2009 (4 pgs).
International Search Report, PCT/CA2009/001657, dated Feb. 17, 2010 (2 pgs).
International Search Report, PCT/US2010/047907, dated Apr. 26, 2011 (3 pgs).
International Search Report, PCT/US2010/047906, dated Mar. 30, 2011 (3 pgs).
International Search Report, PCT/IB06/054574, dated Oct. 27, 2008 (2 pgs).
Office Action, dated Dec. 13, 2011 in U.S. Appl. No. 12/973,109 (27 pgs).
Office Action, dated Sep. 14, 2011 in U.S. Appl. No. 12/430,733 (7 pgs).
Office Action, dated Dec. 7, 2011 in U.S. Appl. No. 12/355,734 (31 pgs).
Office Action, dated Sep. 15, 2011 in U.S. Appl. No. 12/355,740 (6 pgs).
Office Action, dated Dec. 20, 2011 in U.S. Appl. No. 12/355,740 (12 pgs).
Office Action, dated Jun. 29, 2011 in U.S. Appl. No. 12/059,909 (21 pgs).
Office Action, dated Jul. 27, 2011 in U.S. Appl. No. 12/059,909 (34 pgs).
Office Action, dated Apr. 11, 2011 in U.S. Appl. No. 12/095,914 (3 pgs).
Request for Continued Examination, dated Sep. 27, 2011 in U.S. Appl. No. 12/059,909 (18 pgs).
Request for Continued Examination, dated Mar. 30, 2012 in U.S. Appl. No. 12/355,734 (32 pgs).
(Cell Net Data Systems) "First Wireless Monitoring of Parking Meters Results in Theft Arrests Using CellNet Data Systems Technology," PRNewswire, May 11, 1999 (2 pgs).
Meter Solutions, Single-Space Meters brochure, downloaded from www.duncansolutions.com website, revised Apr. 2006 (2 pgs).
Anonymous, "The Originators of Metered Parking, Series II, APM-E Mechanism, Service Manual," POM Incorporated, May 23, 2006 revision (22 pgs).
International Preliminary Report on Patentability, issued for application No. PCT/US2010/047907, dated Mar. 15, 2012 (6 pgs).
International Preliminary Report on Patentability, issued for application No. PCT/US2010/047906, dated Mar. 6, 2012 (5 pgs).
International Preliminary Report on Patentability, issued for application No. PCT/IB2006/054574, dated Mar. 10, 2009 (5 pgs).
Office Action issued for U.S. Appl. No. 12/973,109, dated Apr. 30, 2012 (24 pgs).
Office Action issued for U.S. Appl. No. 12/355,734, dated Apr. 6, 2012 (36 pgs).
Information Disclosure Statement by Applicant filed for U.S. Appl. No. 12/355,734 on May 23, 2012 (22 pgs).
Information Disclosure Statement by Applicant filed for U.S. Appl. No. 12/355,740 on May 23, 2012 (25 pgs).
Information Disclosure Statement by Applicant filed for U.S. Appl. No. 12/875,959 on May 24, 2012 (22 pgs).
Information Disclosure Statement by Applicant filed for U.S. Appl. No. 12/875,975 on May 24, 2012 (22 pgs).
Request for Continued Examination (RCE) and Information Disclosure Statement by Applicant filed for U.S. Appl. No. 12/973,109 on May 31, 2012 (43 pgs).
Information Disclosure Statement by Applicant filed Oct. 23, 2012 for U.S. Appl. No. 12/355,734 (2 pgs).
Office Action issued for related U.S. Appl. No. 13/546,918, dated Sep. 26, 2012 (26 pgs).
Canadian Office Action issued for related application No. 2,770,093, dated Jul. 5, 2012 (5 pgs).
International Search Report & Written Opinion, PCT/CA12/000191, dated Jun. 20, 2012 (8 pgs).
Office Action issued for related application No. 13/410,831, dated Nov. 6, 2012 (46 pgs).
Office Action issued in related U.S. Appl. No. 13/410,831, dated Jul. 12, 2013 (7 pgs).
Flatley, J., "In San Francisco, hackers park for free," posted Jul. 31, 2009, www.engadget.com (1 pg).
Howland, S., "How M2M Maximizes Denver's Revenue," FieldTechnologiesOnline.com, Oct. 2011, pp. 9-12 (4 pgs).
The United States Conference of Mayors Press Release, "The U.S. Conference of Mayors Presents 'Best-Practice' Awards," Jan. 20, 2012, (3 pgs).
U.S. Appl. No. 10/317,414, filed Dec. 12, 2002.
U.S. Appl. No. 12/430,733, filed Apr. 27, 2009.
U.S. Appl. No. 12/788,100, filed May 26, 2010.
U.S. Appl. No. 13/454,976, filed Apr. 24, 2012.
U.S. Appl. No. 29/367,429, filed Aug. 6, 2010.
U.S. Appl. No. 29/367,431, filed Aug. 6, 2010.
U.S. Appl. No. 29/391,605, filed May 11, 2011.
U.S. Appl. No. 29/410,857, filed Jan. 12, 2012.
U.S. Appl. No. 61/048,133, filed Apr. 25, 2008.
U.S. Appl. No. 61/140,543, filed Dec. 23, 2008.
U.S. Appl. No. 08/959,109, filed Oct. 23, 1997, Church et al.
U.S. Appl. No. 13/141,977, filed Jun. 23, 2011, MacKay et al.
U.S. Appl. No. 13/141,983, filed Jun. 23, 2011, MacKay et al.
U.S. Appl. No. 13/410,831, filed Mar. 2, 2012, MacKay et al.
U.S. Appl. No. 13/529,914, filed Jun. 21, 2012, MacKay et al.
U.S. Appl. No. 13/545,871, filed Jul. 10, 2012, MacKay et al.
U.S. Appl. No. 13/546,918, filed Jul. 11, 2012, MacKay et al.
U.S. Appl. No. 29/433,549, filed Oct. 1, 2012, MacKay et al.
U.S. Appl. No. 13/782,818, filed Mar. 1, 2013, MacKay et al.
Canadian Office Action issued for related application No. 2,745,365, dated Jul. 4, 2012 (2 pgs).
Canadian Office Action issued for related application No. 2,745,365, dated Jun. 5, 2012 (2 pgs).
Canadian Office Action issued for related application No. 2,745,365, dated Aug. 26, 2011 (4 pgs).
Canadian Office Action issued for related application No. 2,745,365, dated Mar. 1, 2012 (6 pgs).
POM APM photographs (33 pgs).
Duncan Solutions "Single-Space Meters" brochure, undated (2 pgs).
International Search Report issued for PCT/US2012/048190, dated Jan. 22, 2013 (4 pgs).
McCullagh, D., "Hackers: We can bypass San Francisco e-parking meters," Jul. 30, 2009, http://news.enet.com (2 pgs).
Office Action issued in related U.S. Appl. No. 13/545,871, dated Apr. 12, 2013 (16 pgs).
Office Action issued in related U.S. Appl. No. 13/546,918, dated Apr. 15, 2013 (21 pgs).
Office Action issued in related U.S. Appl. No. 08/959,109, dated Apr. 23, 2013 (10 pgs).
Office Action issued in related U.S. Appl. No. 13/141,977, dated May 8, 2013 ( 4 pgs).
Office Action issued in related U.S. Appl. No. 13/410,831, dated May 28, 2013 (15 pgs).
Notice of Allowance issued in U.S. Appl. No. 13/545,871, dated May 28, 2013 (10 pgs).
Office Action issued in related U.S. Appl. No. 13/141,983, dated Jun. 14, 2013 (68 pgs).

(56) References Cited

OTHER PUBLICATIONS

Office Action issued in related U.S. Appl. No. 13/529,914, dated Jun. 21, 2013 (33 pgs).
Micrel, Application Note 51 Frequency Hopping Techniques, Jun. 2006, Rev. 1.0.
Office Action issued in related U.S. Appl. No. 08/959,109, dated Nov. 21, 2012 (24 pgs).
Office Action issued in related U.S. Appl. No. 13/545,871, dated Nov. 28, 2012 (30 pgs).
Office Action issued in related U.S. Appl. No. 12/973,109, dated Jan. 28, 2013 (19 pgs).
Office Action issued in related U.S. Appl. No. 13/545,871, dated Dec. 28, 2012 (7 pgs).
Office Action issued in related U.S. Appl. No. 13/410,831, dated Feb. 12, 2013 (20 pgs).

* cited by examiner

MKE - III FUNCTIONAL BLOCK DIAGRAM

4 BIT SLAVE MICROPROCESSOR, LEDs, & RESET

LIQUID CRYSTAL DISPLAYS

8 BIT HOST PROCESSOR & EXTERNAL MEMORY

MIXED SIGNAL ASIC

PROXIMITY DETECTOR & RF COMMUNICATION I/F

SWITCHED MODE POWER SUPPLY

SMART CARD INTERFACE & EXTERNAL CONNECTIONS

CNIE - Host enable bit in CCCTRL
CNIS - Proximity sensor sampling rate (0 = 32Hz, 1 = 64Hz)
CNIW - Host wakeup bit
PXIH - Proximity Inhibit (from host)
PXOT - Proximity Output Signal
PXIN - Proximity Input Signal

ELECTRONIC PARKING METER

This is a continuation of application(s) Ser. No. 08/418,018 filed on Apr. 6, 1995 now abandoned.

The present invention relates to electronic parking meters.

BACKGROUND OF THE INVENTION

Parking meters have evolved into rather sophisticated devices as compared with meters of the past. The demands on parking meter manufacturers to provide increased functionality at reduced cost are becoming increasingly more severe. Different jurisdictions have different needs and requirements. Parking meters must be capable of displaying messages in the language required by the customer. To avoid the need of having a number of different models and the associated costs of doing so, a parking meter must be configurable to allow the language of messages to be changed easily. Some jurisdictions require the use of coins while others require the use of so called "smart cards" as the form of payment for parking time. Some jurisdictions require that the parking meter be capable of being interrogated electromagnetically or optically. If a meter is to be capable of being used in different countries, the meter must be capable of discriminating from coins of several countries. Some jurisdictions require that rates for parking time change at period intervals.

Most parking meters now available are electronic and, therefore, require a source of power in the form of batteries. The most severe requirement imposed by customers may be keeping energy consumption by parking meter electronics to a minimum. Obviously, in order to reduce the cost of replacement batteries and the costs associated with physically replacing batteries, an important requirement imposed by customers is maximum battery life. These and other such requirements are over and above the basic functional requirements of parking meters which are to reliably detect the presence of coins, identify the coin, dispense the appropriate amount of time purchased and accurately provide the amount of time purchased before a time expired message.

To be competitive, a parking meter manufacturer must be able to offer a parking meter having these and other, sometimes unpredictable, functions.

Coin Detection

Electronic parking meters typically include a coin proximity detector to signal a microprocessor when a coin enters in a coin chute. The classic inductive proximity detector for metal objects consists of an inductive sensor, an oscillator and a detector circuit. The oscillator and sensor generate an electromagnetic field which radiates and which is often directed toward the target. When a metal object enters the electromagnetic field, eddy currents are induced into the surface of the object resulting in a loading effect which reduces the amplitude of the oscillations. The detector is usually a voltage amplitude sensor designed to produce an output when the amplitude falls below a specified level.

The nominal sensing range of the system is a function of the sensor diameter and the power which generates the electromagnetic field. Variations in the range can be large and it is not unusual to design for 100% margin due to the combined effects of manufacturing tolerances and temperature variations.

The thickness of the target has no significant effect on range if it is thicker than about one millimeter. The shape of the target and its metal content are the major influences on range. Sensing of nonferrous metals is more difficult and the range will be less for these objects. If the sensor must be imbedded in metal, it is usually shielded on all sides but one. This focuses the energy to the front of the sensor, but it also reduces the range of the detector compared to an unshielded sensor of the same size.

Many implementations of the basic proximity detector have been developed. They all consisted of an oscillator, either Colpitts or Hartley, operating at about 100 kHz, and some form of amplitude detector. Some emphasized sensitivity in an attempt to achieve a large change in output amplitude for the smallest targets. Others were micropower circuits designed to operate continuously. A few even combined the ideas and achieved modest success. The sensors included both shielded and unshielded inductors ranging from about 10 millimeters to about 25 millimeters in diameter.

The problem with all circuits was the basic conflict between realizing an oscillator that oscillates readily and reliably and yet exhibits a significant reduction in output in the presence of a minor disturbance (the coin). A stable oscillator experiences only a minor change in output when the field is disturbed, while a marginal oscillator experience changes, but may not regenerate when the disturbance is removed.

The best compromise that could be achieved was a Colpitts configuration biased for 20 microamperes continuous current, which exhibited about a 25% reduction in amplitude for the smallest coins. Unfortunately, temperature variations make this and other attempts virtually useless as reliable proximity detectors.

An alternative design used the sensing coil in a parallel tuned circuit which is driven periodically at a low frequency of about 30 Hz with a very short impulse, generating a decaying oscillatory response. The response is amplified and the number of the natural resonant frequency are counted. The number depends on the Q of the tuned circuit which is determined primarily by the coil.

The presence of metal objects again causes additional losses which reduce the Q and the number of cycles generated in response to an impulse. The output cycles then decrement a presettable counter which periodically restarts a "watchdog" timer as long as the required number of cycles are counted. In the presence of a coin, fewer cycles are counted and the watchdog times out, generating a detect signal. This design suffers from relatively small changes in Q for small coins, a deficiency which can be improved by longer counting intervals at the risk of missing some coins. The technique could be made more adaptive, but that would require either more circuitry or powering the normally quiescent controller to supply the intelligence.

SUMMARY OF THE INVENTION

One aspect of the present invention relates to a proximity detector for detecting the presence of a coin or token in a coin chute, comprising a pair of axially aligned coils disposed on opposed sides of the chute; a common-emitter amplifier having a base and a collector providing a detector output, one of the coils being connected to the collector and the other of the coils being connected to the base.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
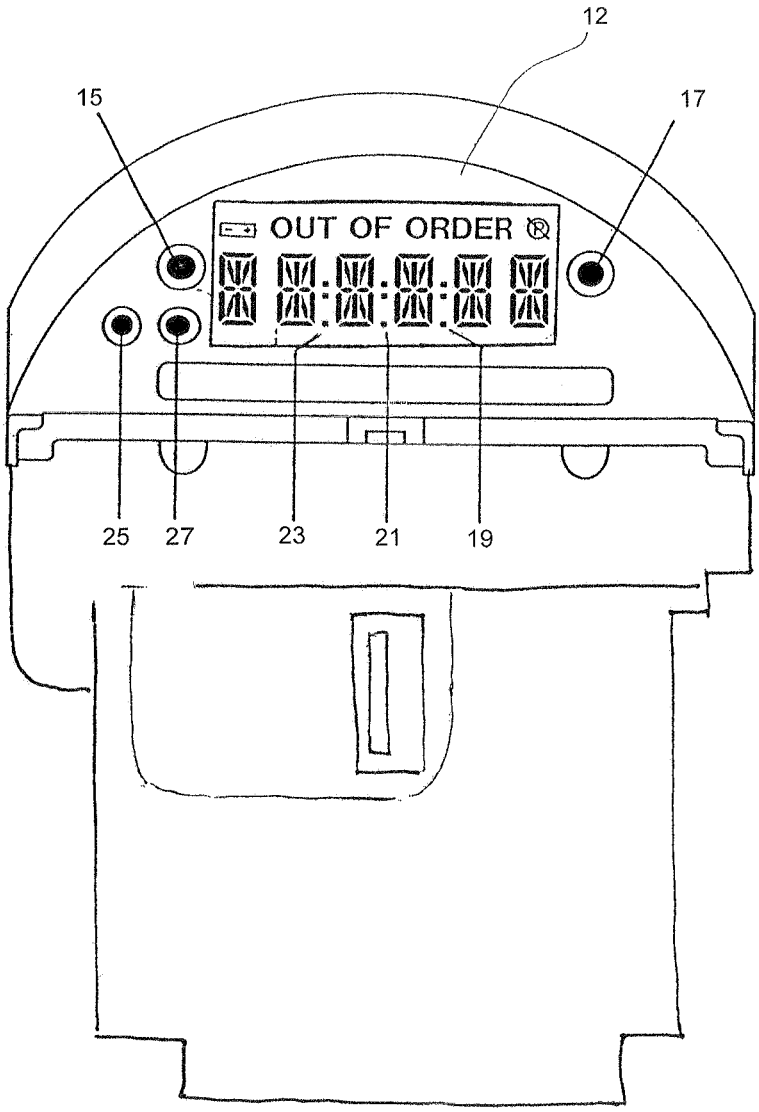
FIG. 1 is a front elevational view of a parking meter according to a preferred embodiment of the present invention.
Figure 28:
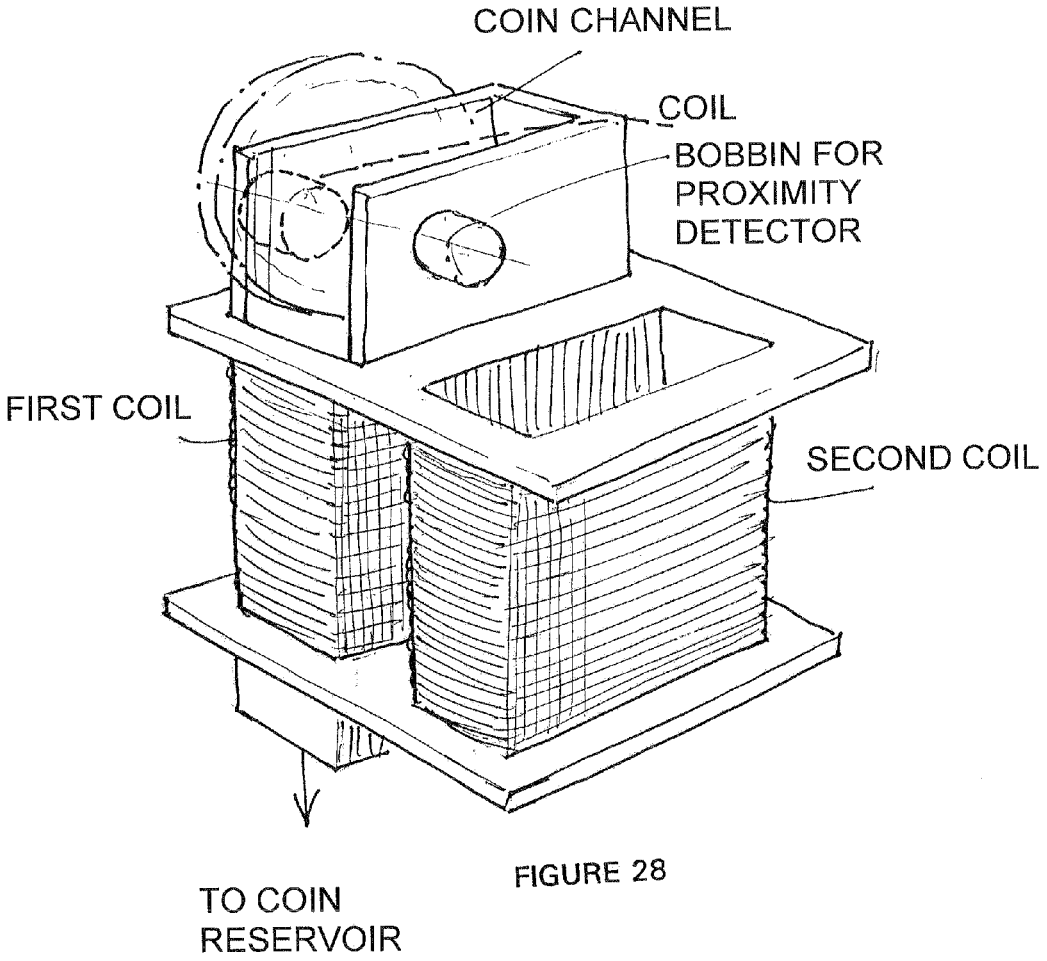
FIG. 28 is a coin chute according to the preferred embodiment of the present invention
Figure 29:
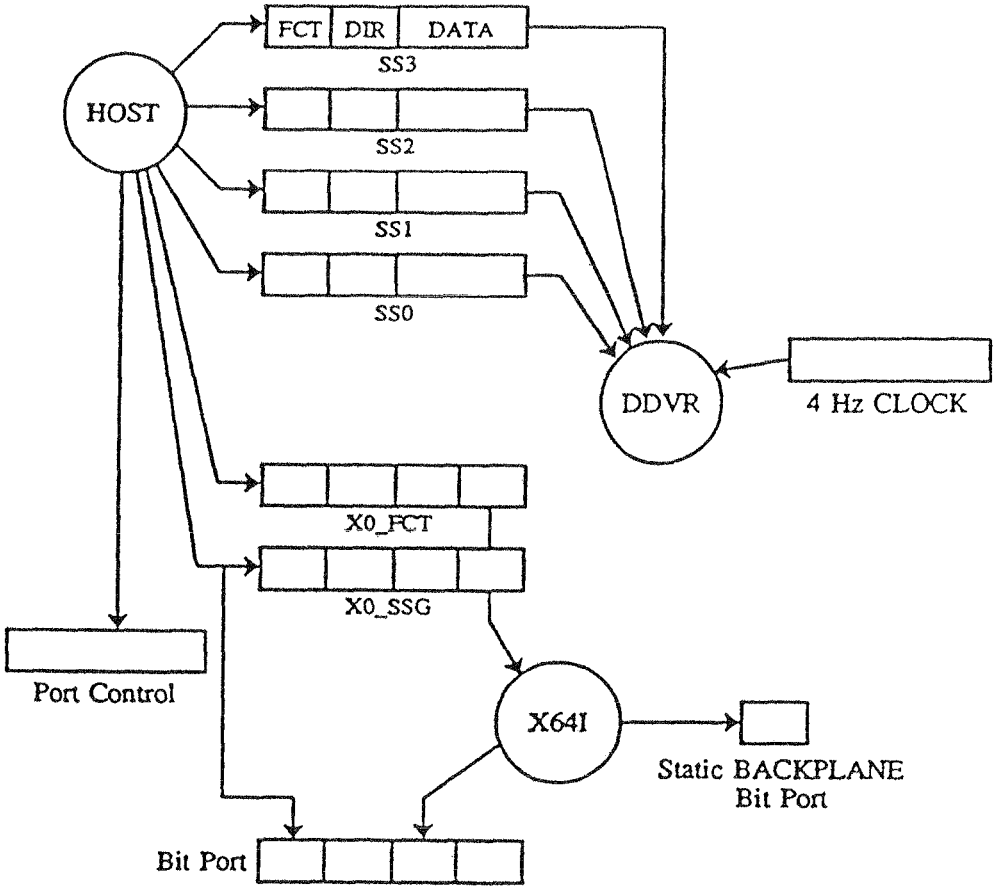
FIG. 29 is a flow diagram respecting the static LCD/GP10 Drivers according to the preferred embodiment of the present invention.

FIG. 1 of the drawings is a front elevational view illustrating external features of a parking meter 10 according to a preferred embodiment invention. The meter includes a housing 12, a display 14 disposed at the upper end of the housing in conventional fashion, a coin slot 16 for receiving coins or tokens, and an optional card slot 18 for receiving and communicating with a smartcard 20. A coin chute 22, shown in FIG. 28, is secured within the housing and provides a vertical passageway between the coin slot and a conventional coin receptacle (not shown) also disposed within the housing.

Display 14 includes a main display 24 having a six-character/96 segment LCD display for displaying Purchased Time Remaining when the meter is in use, a scrolling message when the meter is not in use and other such messages. The display can also be used to alternatively scroll a message and display purchase time. The display also includes a left hand LED 26, a right hand LED 28, an "Out of Order" indicator 30, an "Invalid Coin Indicator" 32, and a "Low Battery Indicator" 34. The display also includes infrared transmit and receive mode indicators 36 and 38, respectively, to indicate when the meter is in infrared transmitting and receiving modes, respectively. One of the challenges associated with providing an parking meter electronic display having so many indicators is maintaining power consumption to a minimum. The manner in which the present invention achieves this objective is described later.

The information displayed on display 14 may be varied according a computer program loaded into the meter. After a user has deposited coins or tokens or inserted a smartcard into the meter, the meter will display the amount of time remaining. The time may be updated at one second intervals for the balance of the unexpired time. Alternatively, the time may be displayed for only a few seconds and then display a series of bars. When time has expired, the display may be blank or may display a scrolling message, perhaps in the form of advertising.

The parking meter of the present invention is capable of communicating with an external computer (not shown) by means of an RF probe 40 connected to the external computer. The external computer may be any conventional, commercially available, portable computer. The RF probe is used to download computer programs and/or data into and/or upload data from the meter. In accordance with one of the many aspects of the present invention, the coin detection circuitry of the present invention serves the dual role of detecting the presence of and measuring coins in the coin chute and effecting RF communications. To effect RF communications, the RF probe is simply inserted into the coin slot. This aspect of the invention is described in more detail later. The meter may also include a conventional infrared transmitter/receiver.

The meter is provided with a generic operating system which reads specific registers stored in non-volatile memory to determine its operating parameters. The parameters, for example, may specify the messages which are to be displayed under certain circumstances, the rates to be charged and the intervals within which those rates apply, etc.

Figure 2:
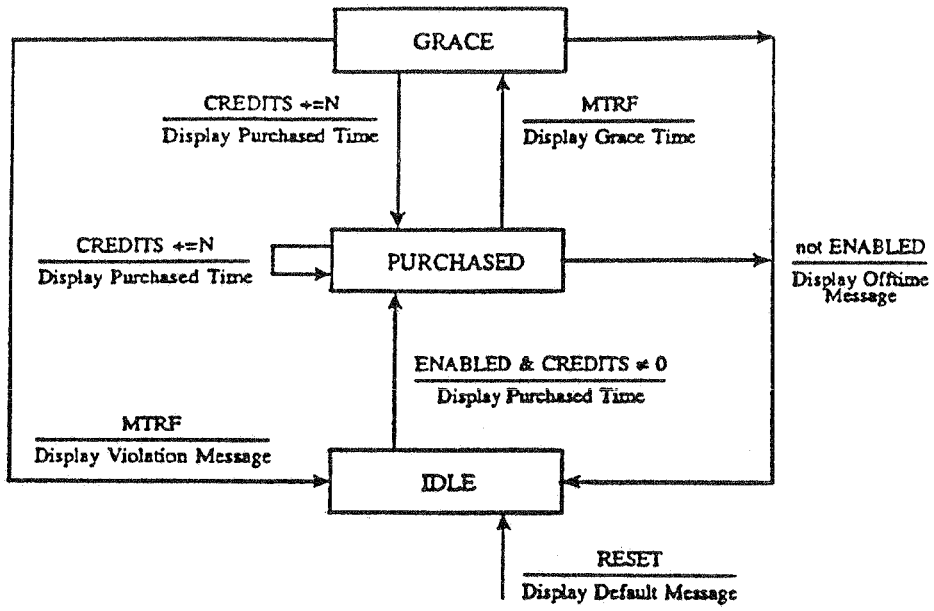
FIG. 2 is a state diagram illustrating the three basic states of the parking meter according to an embodiment of the present invention.

FIG. 2 illustrates the three basic states of the meter in the form of a 3-state machine having an IDLE state in which there is no time purchased, a PURCHASED state in which purchased time remains and a GRACE state which permits some non-purchased time before a violation message is issued. The IDLE state is entered from system reset and a default message is output to the display. The IDLE state transitions to the PURCHASED state when ENABLED and CREDITS flags have been applied. The purchased time is output to the display. The meter remains in the PURCHASED state while credits are applied to the account and transitions to the GRACE state when the purchased time expires. The GRACE state reverts to the PURCHASED state when additional credits are applied or to the IDLE state when the GRACE period expires. The GRACE and PURCHASED states exit to the IDLE state whenever the ENABLED flag becomes false.

Figure 3:
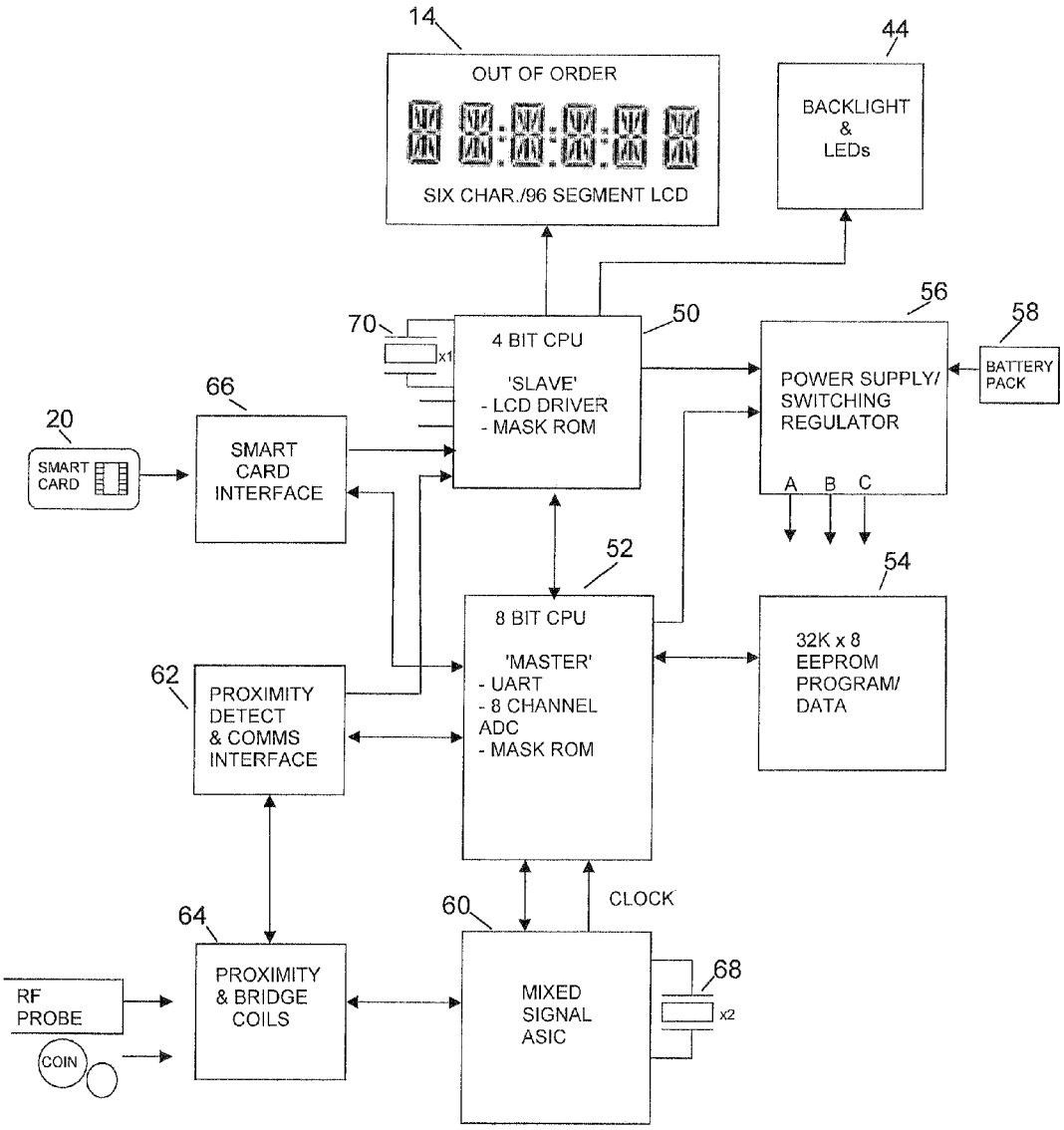
FIG. 3 is a block diagram illustration of the major components of a parking meter according to a preferred embodiment of the present invention.

Reference will now be made to FIG. 3 which is a block diagram illustrating the major components the present invention. The meter is comprised of aforementioned display section 14, including backlight and LEDs 44, a slave controller 50, a master controller 52, memory means in the form of an EEPROM 54, a power supply/switching regulator circuit 56, a battery pack 58, a mixed signal Application Specific Integrated Circuit (ASIC) 60, a proximity and RF communications interface 62, proximity detector coils and bridge coils 64, and a Smartcard detection and interface circuit 66.

Generally, the ASIC provides coin discrimination functions and, more specifically, converts analog signals output by the detectors to digital signals which are then delivered to the master controller. The coin discriminator utilizes a precisely balanced ac-bridge circuit, which is unbalanced during the passage of a coin. The frequency at which the maximum bridge output occurs and the value of that maximum, uniquely identify more than twenty different coins from several countries.

It will be noted from FIG. 3 that a first crystal oscillator 68 is connected to the ASIC. The output of oscillator 68 provides the clock signal for the master controller as well as for the ASIC. It will also be noted that a second oscillator 70 is connected to and provides clock signals to the slave controller 50. Slave controller 50 includes an internal LCD driver and MASK ROM. Master controller 52 includes an internal UART, an 8-channel analog-to-digital converter (ADC) and MASK ROM.

The Processing Section

One aspect of the present invention partitions processing functionality between two controllers 50 and 52. The purpose of this partitioning is to separate quiescent state functions and active state functions in order to optimize power supply requirements. To that end, the power supply system provides a very low current −3.3 volt supply to support the quiescent state functions and a high current −5 volt supply to support active state functions.

The quiescent mode functions are allocated to a very low power (4 μA Active) 4-bit microcontroller, i.e. to slave microcontroller 50. An appropriate commercially available device is an OKI MSM64164GSK microcontroller, which is powered on the low current −3.3 volt power supply. The specific functions allocated to this device include driving the display, coin proximity detector and management, Smartcard detection and management, power management and battery detection, configurable bit port control lines, Watchdog Timer maintenance as well as controlling the various displays including the main triplex LCD display driver, an auxiliary 4 segment static LCD driver, LED operation, real time clock and meter time management.

The Active mode functions are allocated to an 8-bit processor, master controller 52. An appropriate commercially available device is the Texas Instruments TMS370C350FNA. The master controller operates from the −5.0 volt supply labelled VSS in the circuit diagrams described later. Active mode operations executed by master controller 52 include Coin Discrimination, Battery Level Monitoring, User Communications, communications with microcontroller 50, Smartcard Interface communications, coin chute block monitoring, bootload and Program Memory Management and System Diagnostics.

Master controller 52 is preferably provided with an internal mask ROM to store bootloader code to control system reset. Memory is partitioned off of the microcontrollers in order to render the systems as generic and flexible as possible. To that end, the system includes a memory device in the form an EEPROM.

Quiescent State Functions

Main Triplex LCD Display Driver

Figure 4:
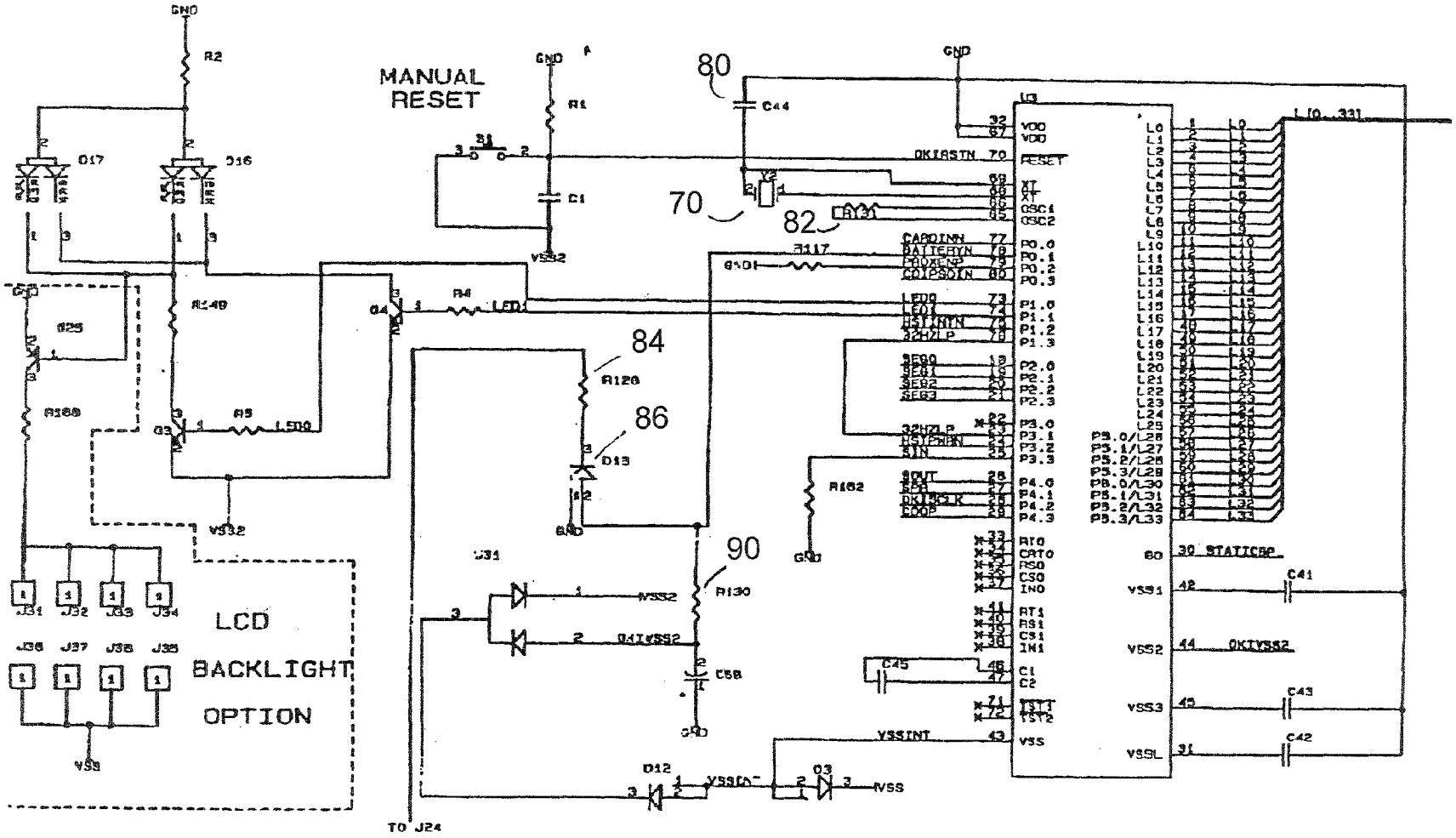
FIG. 4 is a diagram of a slave controller according to the preferred embodiment of the present invention.
Figure 5:
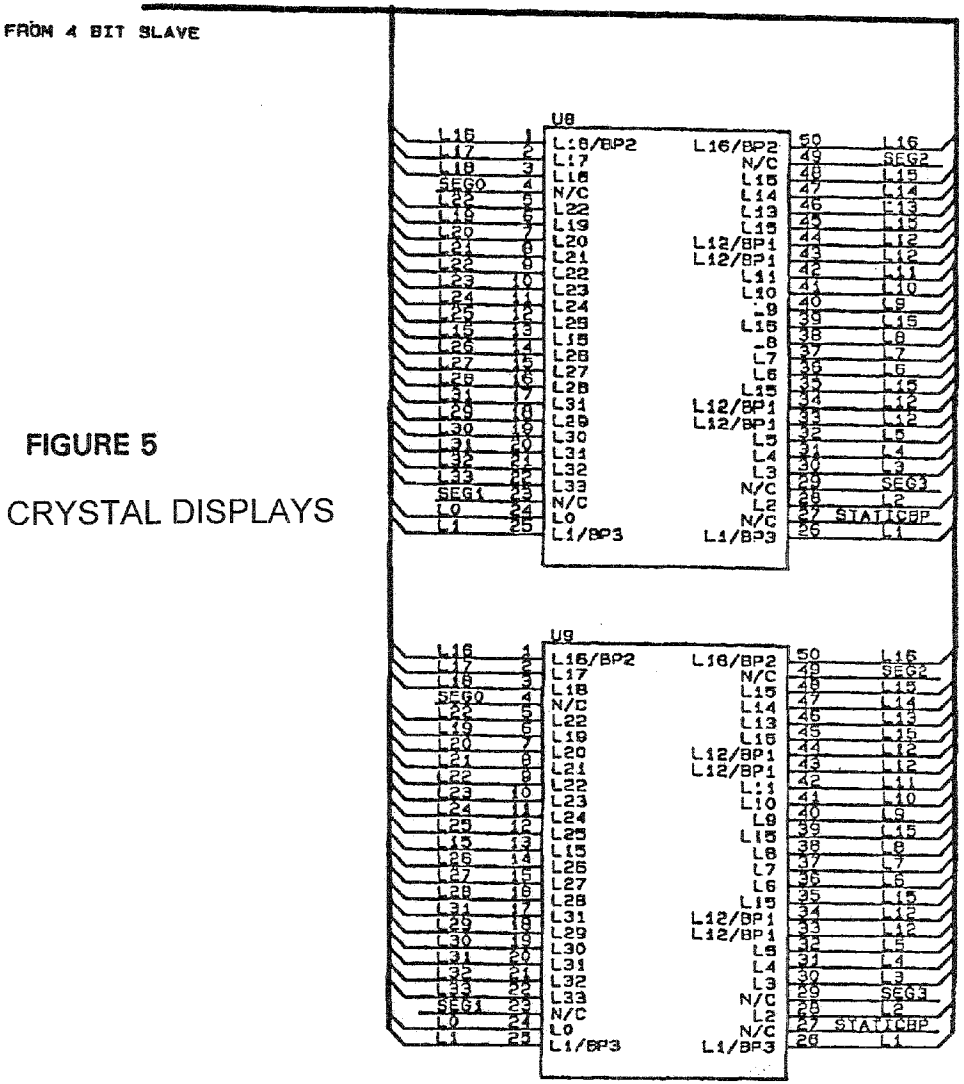
FIG. 5 is a circuit diagram of liquid crystal displays according to the preferred embodiment of the present invention.

With reference to FIGS. 4 and 5, slave controller 50 is provided with a triplex mode LCD driver. A pinout, L0 . . . L33, is allocated to provide a regular routing pattern for the LCD panel when the slave controller 50 is positioned beneath the front LCD glass. Slave controller 50 is provided with an internal charge pump which converts the −3.3 volt (nominal) power supply into an appropriate −4.5 volt LCD drive waveform and, in this way, is able to provide the necessary voltage to drive the display while the power supply provides the low voltage level.

Auxiliary 4-Segment Static LCD Driver

Auxiliary static mode LCD frontplane drivers are implemented with bit ports from bit port 2 on slave controller 50 and a static backplane is generated via the buzzer output configured as a bit port. Ports 1, 2, 3 and 4 on slave controller 50 have built in level translation circuitry that allow them to operate in two modes. When the negative power supply VSS2 (OKIVSS2) and VSS (VSSINT) are at −3.3 volts, the bit ports operate with 0 volts as a logic high and −3.3 volts as a logic low. When the power supply VSS (labelled VSSINT in the drawings) is brought to −5.0 volts, the bit ports operate with 0 volts as a logic high and −5.0 volts as a logic low. This guarantees proper interface between the two processors even though they run on a split power supply system.

The effect of the voltage swing transition of the frontplane signals for the static display will be minimal. The buzzer output does not have the translation circuitry and always operates between 0 volts and −3.3 volts (VSS2). When static segments are ON and the frontplane and backplane signals are out of phase, a change to active mode results in a slightly larger average power being delivered to the LCD segments. When static segments are OFF and frontplane and backplane signals are in phase, a change to active mode will result in a slight increase in average power delivered to the LCD segment on one half of the segment update cycle, but not enough to turn the segment ON.

Coin Proximity Detector and Management

An electronic proximity detector, described later, provides an output indicative of the presence of an object in the coin chute. Slave controller 50 monitors the output of the proximity detector at predetermined, software selectable intervals of 32 or 64 Hz. While the output could be monitored continuously, doing so would considerably increase energy consumption and would not provide better monitoring of the detector. A low level detector output indicates no activity in the coin chute and, therefore, no further action need be taken. Conversely, a high level output indicates the presence of an object. Slave controller 50 responds to the latter situation by initiating a master controller 52 wakeup sequence described later. Master controller 52 subsequently determines whether a coin has entered the chute, the chute has been obstructed or an RF probe has been inserted into the chute. These functions are described more fully later.

Smartcard Detection

Figure 10:
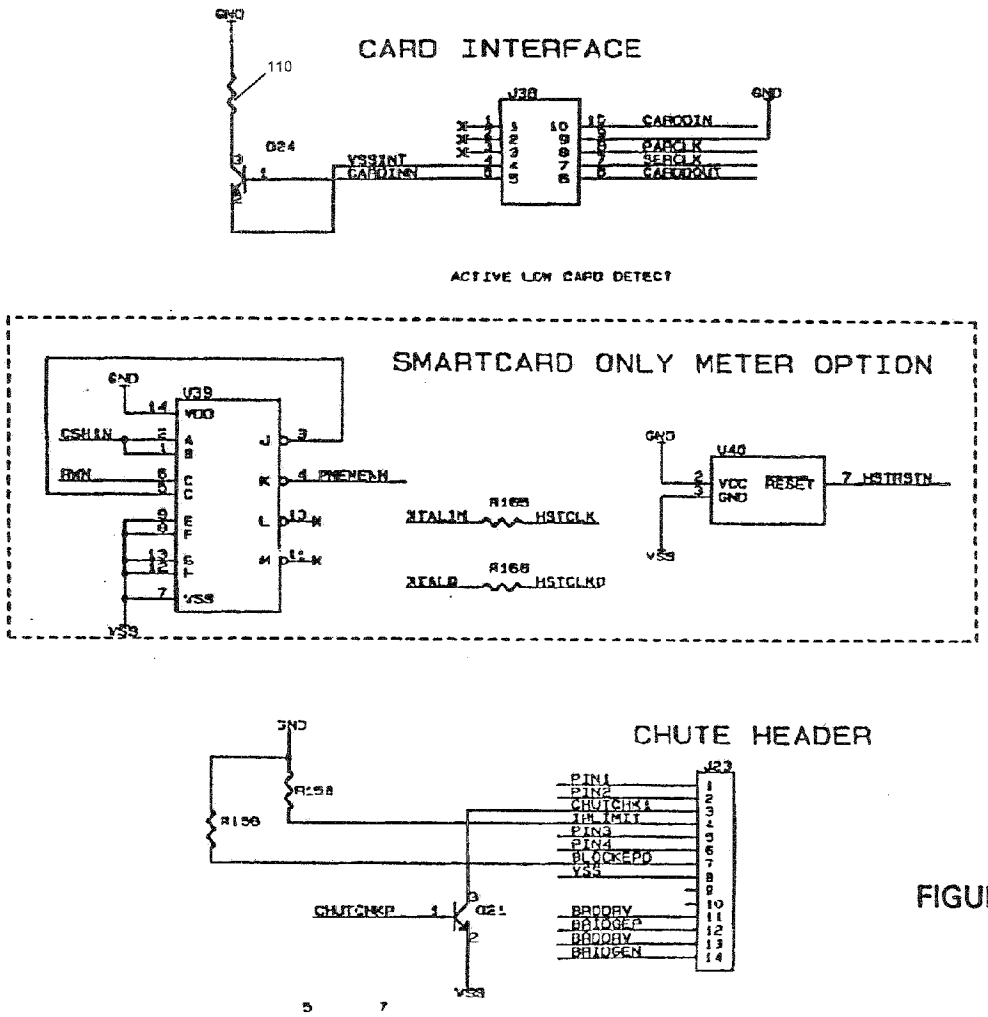
FIG. 10 is a circuit diagram of a card interface according to the preferred embodiment of the present invention.

The smartcard feature is optional. However, the apparatus is provided with the circuitry necessary to monitor and communicate with a smartcard via the smartcard interface shown in FIG. 10. When the smartcard option is installed, a bit port on slave controller 50 is dedicated to the periodic sampling and detection for smartcard insertion. A normally open switch is located on the smartcard interface. At a period of 64 Hz, the logic state of a CARDINN signal is sampled (see FIG. 4). A high level signal indicates that no card is present and no action is taken. A low level signal indicates the presence of a card which causes slave controller 50 to initiate the master controller wakeup sequence.

Real Time Clock and Meter Time Management

Slave controller 50 contains an internal time base counter for generating a real time clock and meter time management. The time base counter is based upon a 32.768 kHz crystal oscillator 70. An external trimmer capacitor 80 (see FIG. 4) is provided to allow a factory trim of the initial oscillator set point. During quiescent operation, slave controller 50 code executes from the 32.768 kHz crystal oscillator. This maintains a low power and slow, but sufficient, mode of operation. During meter wakeup sequences, slave controller 50 starts a secondary RC oscillator formed with an internal capacitor and external resistor 82. The controller code then switches to the faster clock oscillator source and operates approximately 12 times faster.

Power Management and Battery Detection

Figure 9:
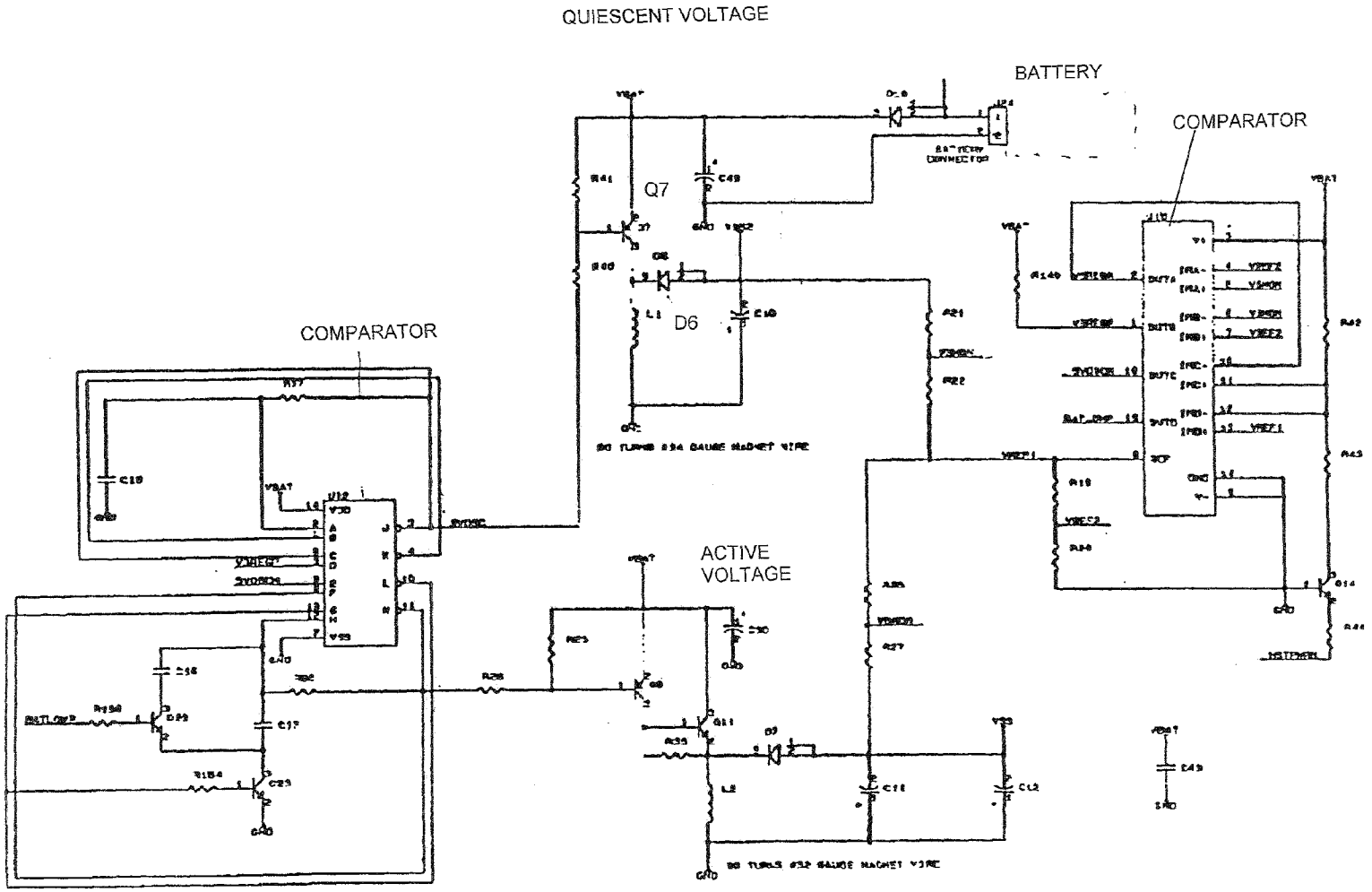
FIG. 9 is a circuit diagram of a switched mode power supply according to the preferred embodiment of the present invention.

Slave controller 50 generates the required conditional control signals to turn the −5.0 volt power supply system ON and OFF. The −5.0 volt power supply system is turned ON when a control signal HSTPWRN (FIGS. 4 and 9) is set low. The −5.0 volts power supply system is turned OFF when this control signal is high. The signal HSTPWRN signal is enabled and the −5.0 volt supply system turned ON when one or more of the following events occur: (a) a preset alarm timer expires, (b) a proximity detector trip occurs, (c) a smartcard detection occurs, (d) a watchdog timer fault has occurred, or (e) a system reset sequence is detected. The signal HSTPWRN is disabled and the −5.0 volt supply system is turned OFF only when the following events occur: (a) master controller 52 requests a power down sequence, (b) the watchdog timer has not been serviced within a predetermined time interval, or (c) the battery has been removed from the unit.

When the HSTPWRN signal is activated, slave controller 50 begins a sequence that depends upon the successful servicing of a watchdog timer interface described later. Slave controller 50 begins a recovery sequence if the watchdog timer has not been serviced after the HSTPWRN signal has been activated, indicating a failure of either the −5 volt power supply or the active processor section. The recovery sequence involves deasserting the HSTPWRN signal for a short period of time and then reasserting the signal. If the result of this sequence is another failure to service the watchdog timer, slave controller 50 executes a meter shutdown sequence similar to that when the battery is removed from the unit. Recovery from this state can only be achieved through a full, manual meter reset.

With reference to FIG. 4, battery detection is provided by a simple level translation circuit formed by resistor 84, diode 86, resistor 88 and resistor 90 (see FIG. 4). When a battery is present, resistor 84 is pulled to VBAT, diode 86 is forward biased, and a signal BATTERYN is pulled to approximately 0 volts via a voltage divider formed by resistors 88 and 90. When the battery is removed, the voltage on the resistive divider of resistors 88 and 90 is also removed and BATTERYN collapses to the VSS2 power supply rail. When the BATTERYN signal has collapsed to VSS2, slave controller 50 disables the HSTPWRN signal, turns OFF LED0 and LED1 (if they are ON), shown in FIG. 4, and disables the proximity detector. Functions are not re-enabled until the battery has been restored to the unit.

Configurable Bit Port Control Lines

The slave controller controls four auxiliary static display frontplane signals which can be alternately configured as read/write bit ports for use as control or monitoring lines.

Watchdog Timer

A watchdog timer is provided across the controllers. This means that the functional timer resides in slave controller 50 and a watchdog timer servicing routine is run on microcontroller 52. An interface to service the watchdog timer is attained over a master controller 52 to slave controller 50 serial peripheral interface 72'. The watchdog timer is active only when active mode functions have been activated by turning the −5 volts power supply ON by asserting the HSTPWRN signal. The watchdog timer is provided to encompass details such as the detection of program memory errors, system failures, and system diagnostics. If, during an active period, the watchdog timer is not serviced within a four second interval, a watchdog timer power deactivation sequence is triggered as indicated earlier and an error recovery sequence is initiated (described later with reference to Bootloader and Program Memory Management).

Master controller 52 and Active State Functions

Figure 6:
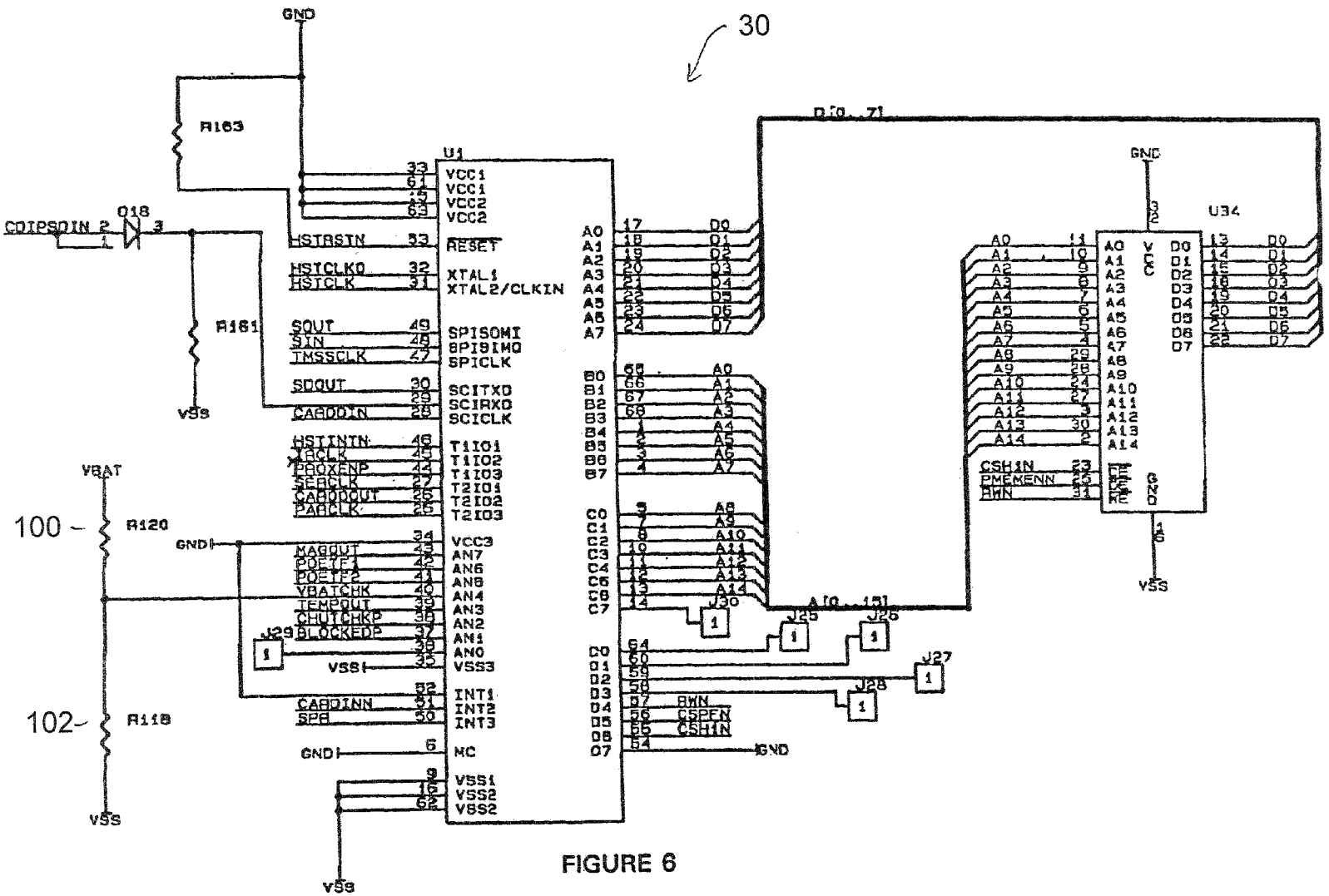
FIG. 6 is a circuit diagram of a master controller and associated memory according to the preferred embodiment of the present invention.
Figure 7:
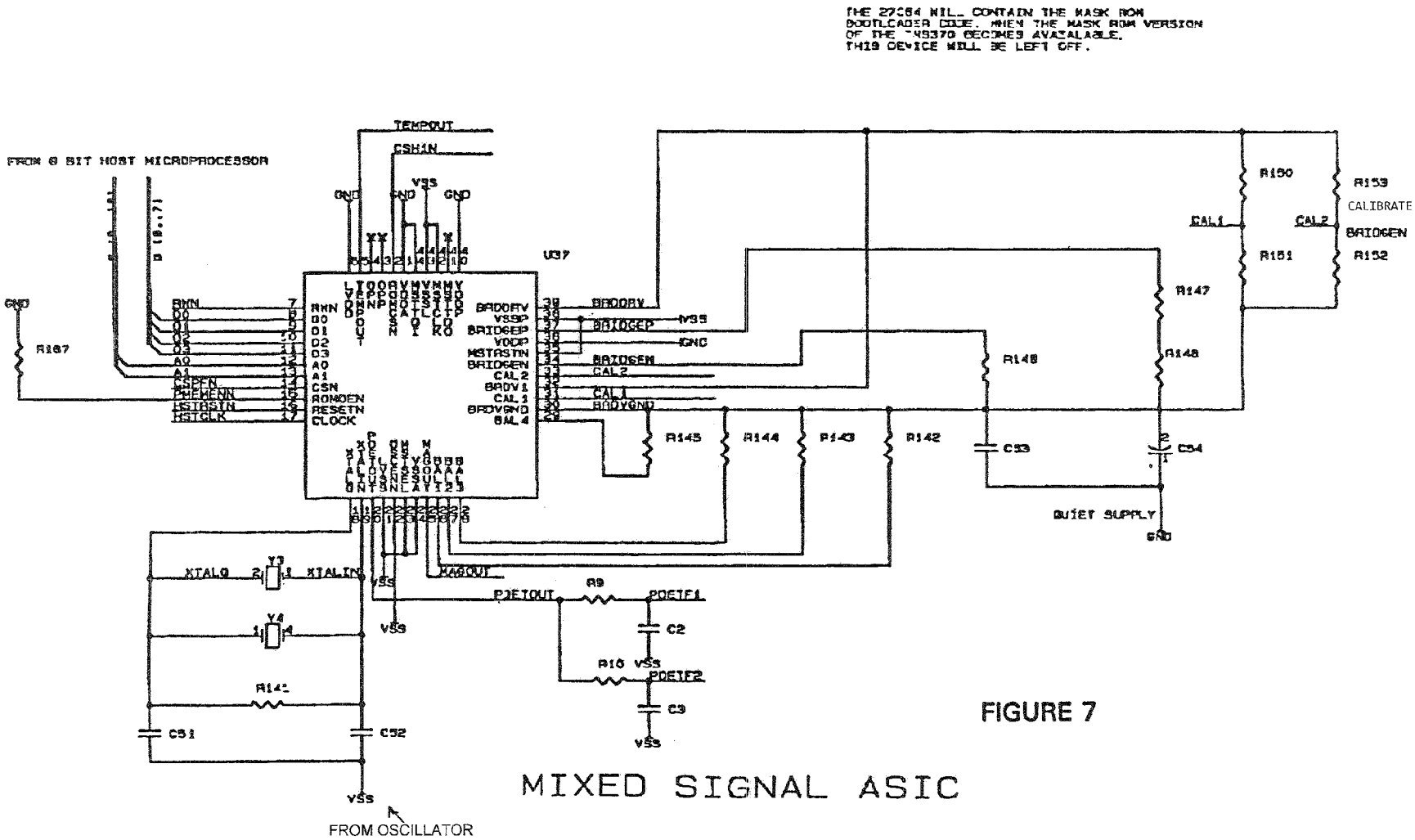
FIG. 7 is a circuit diagram of a mixed signal Application Specific Integrated Circuit (ASIC) according to the preferred embodiment of the present invention.

The basic mode of operation of master controller 52 will now be described with reference to FIG. 6. As previously mentioned, active mode functions are the responsibility of master controller 52. Master controller 52 operates from the −5.0 volt supply labelled VSS. This power supply is directly controlled by the slave controller 50 bit port HSTPWRN. System clock HSTCLK and processor reset HSTRSTN (open drain) are generated by the coin discrimination ASIC.

When HSTPWRN is activated, the VSS power supply begins to swing from zero volts towards −5.0 volts. The HSTRSTN signal is held at the negative rail by the coin discrimination ASIC as VSS begins to ramp down. Crystal oscillator 68 on the coin discrimination ASIC begins to run at about −3.0 volts and the resultant clock signal is buffered and sent to master controller 52 as the signal HSTCLK. When the voltage reaches −4.5 volts, a voltage comparator within the ASIC releases a 500 μS delay counter. When the delay counter expires, the reset signal HSTRSTN releases and master controller 52 begins to execute.

The power down sequence for master controller 52 is controlled for the most part by logic in the coin discrimination ASIC as discussed earlier with reference to Power Management and Battery Detection. As HSTPWRN is deasserted, the VSS supply begins to drop potential. A comparator within the ASIC detects a drop below 4.5 volts. HSTRSTN is instantly asserted and master controller 52 is powered down in a controlled fashion.

The memory map for master controller 52 has been allocated to provide, a secure mask ROM bootload section and configurable program personality code. All external access address decode is provided by address decode logic contained in master controller 52 configured in microcontroller mode with Function A expansion. This mode provides an active a low write enable signal RWN, an active low program memory chip select signal CSH1N and an active low peripheral select signal CSPFN. One additional control line for address decode is provided by the coin discrimination ASIC, and this is the program memory output enable signal PMEMENN which is a decoded combination of the RWN, CSH1N and HSTRSTN signals. The active mode functions will now be described briefly.

Coin Discrimination

The coin discrimination functionality provided by master controller 52 encompasses management of the mixed signal coin discrimination ASIC resources, sampling of the resultant analog signals, and execution of coin discrimination algorithms (including bridge balance). Master controller 52 interfaces to the mixed signal ASIC, U37 via a 4-bit wide data bus labelled D[0.3], and accesses are qualified by the address decode signal CSPFN and the two address least significant bits (Isles) A0 and A1.

The mixed signal ASIC provides an analog interface to master controller 52 via a built-in 8-bit A/D converter. A signal MAGOUT is a linear 0 to 5 volt signal which is linearly proportional to the difference signal as detected across a coin discrimination bridge described later. This signal is sampled on channel 7 of the master controller 52 A/D converter. An output signal PDETOUT is a CMOS digital signal from the mixed signal ASIC which is low pass filtered to generate a linear 0 to 5 volt signal. This filtered signal indicates the phase relationship between a bridge input signal BRDDRV and a bridge output difference signal. The system generates two of these filtered signals from the same digital output, allowing the system to choose the optimal step response and ripple characteristics of the two. A first signal PDETF1 is filtered by the RC low pass combination of R9 and C2 and is Intended for the lower frequency ranges where phase accuracy tends to be a bit better but filtered phase detector step response is poor because of the lower frequencies. Signal PDETF1 interfaces to master controller 52 via A/D channel 6. A second signal PDETF2 is filtered by the RC low pass combination of R10 and C3 and is intended for the higher frequency ranges. PDETF2 interfaces to master controller 52 via A/D channel 5.

Battery Level Monitoring

Master controller 52 monitors the actively loaded battery condition via a signal VBATCHK on channel 4 of the A/D converter. VBATCHK is derived from a resistive divider formed by resistors 100 and 102 which provides a ratio of the varying battery voltage VBAT and the static −5 volt supply voltage VSS. In general, sensitivity is about 66 mV of battery voltage per A/D step. Low battery thresholds are set in software and vary with different battery configurations.

User Communications

As previously mentioned, master controller 52 contains an integral UART which is used for user communications. A signal SDOUT is the 5 volt UART transmit signal and a signal CDIPSDIN is the 5 volt UART receive signal. CDIPSDIN is also connected to slave controller 50 and is alternatively used for proximity detection.

Figure 8:
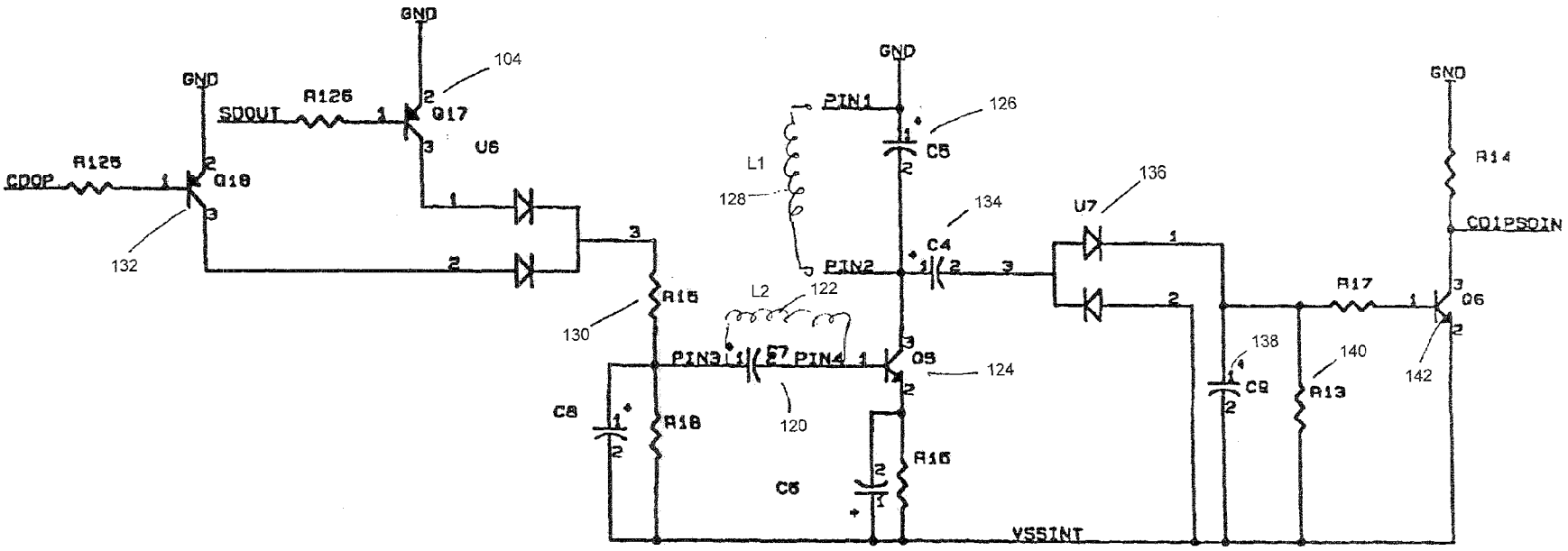
FIG. 8 is a circuit diagram of a proximity detector and RF communication interface according to the preferred embodiment of the present invention.

The proximity detector power supply increases from the −3.3 volt supply to the −5 volt supply when master controller 52 is powered to allow the CDIPSDIN signal to interface directly with the master controller 52 UART. The rf communications link is a half duplex link, with master controller 52 as the initiator. To communicate, master controller 52 first disables the coin detect operation of the proximity detector. It does this by resetting a PROXENP signal, which stops the coin detection algorithm in slave controller 50. Serial data is then transmitted via SDOUT and is used to gate the proximity detector oscillator ON and OFF. This is accomplished by turning ON and OFF the biasing voltage to the proximity detector circuit via transistor 104 (FIG. 8). The result is a modulated pulse stream which can then be recovered with an appropriate receiver configuration.

Generally speaking, there is a communications protocol which allows the meter to ask for and then receive specific packets of information. Once a transmit packet has been sent, master controller 52 initiates a listen mode in which master controller transmissions stop and the proximity detector becomes a receiver.

Slave Controller 50 Communications

Interface between controllers 50 and 32 is achieved with a serial peripheral interface, a function contained on both processors. Master controller 52 provides the master clock, labelled SCLK, for this interface, and slave controller 50 is a slave. The frequency of SCLK has been chosen at around 100 kHz to accommodate the maximum transfer frequency of slave controller 50.

Serial data is transmitted from master controller 52 to slave controller 50 on a signal SIN and received from slave controller 50 on a signal SOUT. A signal SPR is generated by slave controller 50 to indicate that it is ready for the next byte transfer and this signal is connected to interrupt 3 on master controller 52 so that it may be polled or interrupt driven.

Card Interface Communications

Detection of a smartcard is provided by slave controller 50, as already mentioned; however, after system powerup, all communications with the smartcard interface are provided by master controller 52. Smartcard interface functions are provided on a daughterboard configuration which contains a serially loaded 8-bit control register. Interface to this unit is provided by bit software controlled ports to provide the correct protocols. A signal CARDINN is normally pulled high by resistor 110 (see FIG. 10). Insertion of a card closes a normally open contact and pulls CARDINN to VSSINT. The slave controller 50 detects the presence of the card and powers up master controller 52. As the −5 volt supply turns on, VSSINT increases from −3.3 volts to −5 volts for interface with master controller 52. Interface data is transmitted on a bit port labelled CARDDIN and clocked with a signal SERCLK. 8-bits are written in this manner and then loaded into the control register with a signal PARCLK. Data is shifted out from the card interface to master controller 52 via a CARDDOUT signal.

Chute Block Monitoring

A bit port pair on master controller 52 are dedicated to allow an IR LED and IR detector combination to indicate the presence of non-metallic jams in the coin chute.

Bootload and Program Memory Management

As indicated earlier, master controller 52 contains mask ROM and can execute from both internal mask ROM program memory and external EEPROM based mask ROM memory. The internal mask ROM program memory is dedicated to bootload, program download and program memory management.

After reset, master controller 52 jumps to the internal mask ROM program memory. A test of the external program memory indicates whether or not a location designated as the program valid byte has the proper value. If it has, master controller 52 immediately jumps to execute external program memory. If the byte is not valid, master controller 52 initiates a download sequence. No servicing of the watchdog is done if no valid communications are established and master controller 52 enters an error recovery sequence and then an out of service mode.

If the program valid byte is correct but the program memory has been corrupted, master controller 52 will begin to execute in external program memory, fail to service the watchdog timer interface, and enter the error recovery sequence.

The error recovery sequence, which executes whenever a watchdog timer interrupt sequence occurs, marks a program valid byte as invalid. When this byte is detected as invalid, the bootloader code is activated, and the program attempts to initiate communications for a program download. No servicing of the watchdog timer is done during this initial attempt at download, which means that if no communications device is present, the meter out of service mode is entered. This effectively shuts down the meter. Exit from this mode is possible only by an external system reset.

Program memory management software is contained in the master controller 52 mask ROM. This program supports EEPROM page write and software controlled write enable and disable sequences (Catalyst 28C256 and similar devices). During write sequences to program memory, the mask ROM portion of the program memory contains the proper routines to transfer data buffered in master controller 52 internal SRAM into the external EEPROM. The master controller executes out of the internal mask ROM program memory for this transfer sequence because the EEPROM is taken temporarily out of service by the write operation. This program memory management hook is available to both the internal mask ROM bootloader code as well as the externally accessed EEPROM user programs.

System Diagnostics

Master controller 52 is available to execute limited system level diagnostics, however, these need not be described herein inasmuch as they do not form part of the invention.

Proximity Detector

The present invention provides a simple and effective proximity detector which overcomes many of the disadvantages of the prior art discussed earlier. In general, the proximity detector utilizes two coils, one in the collector and the other in the base of a simple common-emitter amplifier. The detector is based on the basic principle that stable operation depends very strongly upon proper alignment and spacing of the two coils. Any disturbance, even minor ones, will cause the oscillations to cease completely. When the interference is removed, the oscillator restarts reliably.

FIG. 8 illustrates the elegant simplicity of this circuit. Two coils are wound on 14 mm by 8 mm bobbins located directly opposite each other on either side of a coin slot. With no coin or metal object in the chute, the circuit oscillates at about 400 kHz with an amplitude of 3 volts peak-to-peak. Even a false aluminum coin the size of a dime will cause the oscillator to stop, reducing the output to zero. The oscillator is followed by a simple envelope detector and level shifter as required by the controller.

The proximity detector is implemented with an inductively coupled oscillator. The detector circuit consists of a tuned circuit which is formed by the combination of capacitor 120, a 1.8 nF capacitor in parallel with one air core bobbin 122 at the base of transistor 124, and capacitor 126, a 3.3 nF capacitor in parallel with another identical air core bobbin 128 at the collector of transistor 124 specified inductance of the air core bobbins is approximately 68 μH or 100 turns of 28 gauge wire). For the oscillation to start, a biasing voltage must be applied to resistor 125, allowing transistor 132 to turn ON. From there, out of phase inductive coupling between the two air core bobbins provides feedback to start and maintain the oscillation. The base and collector circuits are slightly detuned to enhance the ability to stop the oscillator by breaking the inductive coupling between the bobbins (i.e. by blocking the physical path with metal).

The operation of the proximity detector circuit as a coin detection system can be described as follows. At a software selectable period of either 32 Hz or 64 Hz, slave controller 50 samples the PROXENP signal. If the signal is low, the proximity detector is disabled and no further action is taken. If this signal is high, the proximity detector is enabled. Then, if the BATTERYN signal is high, indicating that a battery is installed, output signal CDOP is set low, turning transistor 132 ON and biasing the proximity detector oscillator.

On the next processor cycle (approximately 60 μS later), slave controller 50 samples the CDIPSDIN signal. If the CDIPSDIN signal is low, the proximity oscillator is operational and the rectified and filtered voltage generated by the combination of capacitor 138, diode 136, and resistor 140 is enough to turn transistor 142 ON. No metal is blocking the proximity bobbins. If the CDIPSDIN signal is high, the oscillator did not start and presumably something metallic (i.e. a coin) is blocking the proximity bobbins. The slave controller 50 then starts the master controller 52 wakeup sequence.

Regardless of the result, on the next processor cycle, slave controller 50 resets the CDOP signal low which turns the proximity detector oscillator OFF. This oscillator active period is approximately 120 μS long and repeats at the software selected repetition period.

RF Communications

It has been found that, advantageously, the proximity detect circuit can serve an additional role without modification. That role is to effect RF communications with a suitable RF probe described below.

RF Probe

The RF probe consists of a circuit board substrate, 1/16" thick, 0.75" high, and 3.0 in length. The thickness and height determine the minimum coin slot dimensions that will allow the probe to be inserted into. Only about 1.5" of the circuit board substrate is inserted into the coin slot, and a notch in the substrate is provided to allow the coin slot to drop into when the probe is inserted in through the coin slot. The inserted portion of the RF probe contains copper clad substrate, and a hollowed out section of the circuit board which has a tightly wound coil inserted into the hollowed out section. The copper clad portion of the circuit board serves to interrupt the meter proximity circuit as it is inserted. The probe continues to be inserted until the coin slot drops into the notch described above. When the probe has positioned to the slot position, the coil is now perfectly aligned between the proximity detector coils of the meter.

When the meter receives the coin interrupt, generated by the insertion of the probe, it will first try and measure the physical properties of an object that would normally drop down the coin chute and into the balanced bridge coil arrangement. With the absence of any object, the meter under program control will transmit a communications packet by sending serial data out (SDOUT) from the 8 bit microcontroller. The SDOUT serial data signal will alternatively turn on and off transistor 104 (FIG. 5) which in turn will activate the proximity oscillator circuit, which will immediately begin to oscillate at 400 Khz. In this fashion, the meter is modulating the data. Oscillation will take place because the coil of the RF probe appears transparent to the proximity detector when L1 is not terminated by a low impedance. The modulated signals from the meter are coupled to coil on the RF probe, and that same received signal is coupled through capacitor (C5) to a common emitter amplifier circuit consisting of transistor Q1, and resistors R2, R3, R7, and R8. The amplified 400 Khz signal is coupled through capacitor C3 where the signal is filtered and stripped of it's modulation frequency by wave shaper components D1, C4. At this time the serial data has been demodulated, and is level translated to a TTL level and inverted by transistor Q2 and resistors R5, R6 and R4. The serial TTL level data stream enters pin 2 of IC (U1) which is a MAX233ACWP TTL to RS232C level converter IC. The serial data is inverted, and level shifted to the RS232 (+/−12V) levels on pin 5 and sent to the computer or other device that will receive and interpret the serial data.

When the receiving computing device receives the signal from the meter it will send the serial RS232 serial data to pin 4 of IC (U1) which level shifts it and inverts it to TTL levels, on pin 3. The serial data on pin 3 of IC(U1) is passed to one input of a logical two input OR gate, U2D. The alternating high and low signals of the serial data stream arriving on the input pin to this gate will alternately force the gate U2D to break into oscillation at a frequency determined by the reactive components C6, C7 and the RF probe coil. The oscillation frequency is approx. 400 kHz. The modulated serial data signal is coupled across to the meter through the proximity detector coils L2 and L1. The proximity detector oscillator is disabled while the remote computer is transmitting, thereby making the communications system a half duplex one. The modulated serial data stream is coupled through capacitor C4 and in an identical fashion as done on the RF probe, it is stripped of the modulation and wave shaped by components 136 (FIG. 8) and capacitor 138. The serial data signal is then level shifted and inverted by transistor 142. The serial data stream is then passed to the 8 bit microcomputer for interpretation by the on board UART.

Power Supply Circuit

The Power Supply System consists of a dual switching combination which provides a low current, quiescent voltage and a higher current active state voltage.

Low power quiescent mode runs continuously and is designed to have an active quiescent current of less than 20 μA while maintaining a nominal supply voltage of 3.4 volts. Maximum supply current from the low quiescent mode supply is in the range of 5-10 mA. Typical load demand on this supply is in the range of 20 μAh. The higher current active state supply is designed to maintain a supply voltage of 5 volts (±5%) while sourcing up to 50 mA of current.

The supply system is comprised of three subsections: an oscillator subsection, a comparator subsection and a voltage inverter subsection. The remainder of this section provides a detailed operational description of each of these subsections.

The oscillator section is realized with a 4093 CMOS Schmitt triggered nand gate. The nand gates are configured as two pairs, one forming an oscillator for the low quiescent current power supply and the second forming an oscillator for the higher current active state supply. The pairs of two nand gates are configured in a manner which results In an astable multivibrator circuit. Special characteristics of this astable include the following. An ON/OFF switch is used for voltage regulation. A latching mechanism provided by feedback eliminates the possibility of short pulses at the end of a pulse train which could reduce power supply efficiency. In addition, the astable for the higher power supply includes transistor Q23 which ensures the consistent period of starting pulses in a pulse train and transistor Q20 which reduces the frequency of operation for a battery condition of less than a predefined value.

The comparator section consists of a low quiescent current comparator, bandgap reference and voltage divider resistors. One comparator is used for the low quiescent current supply while three are used for the active state supply.

The comparator system for the low quiescent state supply is fairly simple. Voltage divider R19 and R20 provides a reference voltage (labelled VREF2) of approximately +0.9 volts. Regulation resistive divider R22 and R21 is referenced from the bandgap +1.8 volts and the inverter generated voltage of −3.4 volts. When the negative voltage threshold of nominally −3.4 volts is crossed, the output voltage from the regulation divider goes below 0.9 volts and the output of the comparator V3REGP goes high. This disables the astable multivibrator oscillator (output 3VOSC) and stops the inverter. The oscillator stays disabled until the voltage at the output of the inverter rises above the value preset by the regulator resistive divider.

The comparator section for the active state supply operates in a similar manner. VREF2 is compared against the output of regulation resistive dividers R27 and R28 to maintain nominally −5 volts at the output of the active state inverter. The output of the active state comparator V5REGN is opposite the polarity of the V3REGP output since it is fed into a second comparator which is used as a gate for an ON/OFF switch. If transistor Q14 is turned on, output 5VOSCN will enable and disable the active state oscillator as required to regulate the −5 volt power supply. If transistor Q14 is turned off, the active state oscillator is disabled by the signal 5VOSCN (i.e. It is high).

A fourth comparator is used to detect when the battery voltage drops below 5.5 volts. Resistive divider R42 and R43 provide nominally 1.8 volts when VBAT is 5.5 volts. Signal BATLOWP becomes active and reduces the frequency of the active state oscillator. This is a requirement of the active state 5 volt inverter.

The Inverter Subsection includes two inverters. The low quiescent state inverter consists of transistor Q7, inductor L1, diode D6 and capacitor C10. The active state inverter is formed by transistor Q8 and 011, inductor L2, diode D7 and capacitors C11 and C12. Values for both inverters are chosen to optimize efficiency and performance.

Software Description

The following description describes the architecture of the firmware and results from partitioning the functionality into coherent subprogram modules and the scheduling requirements for these functions.

Figure 11:
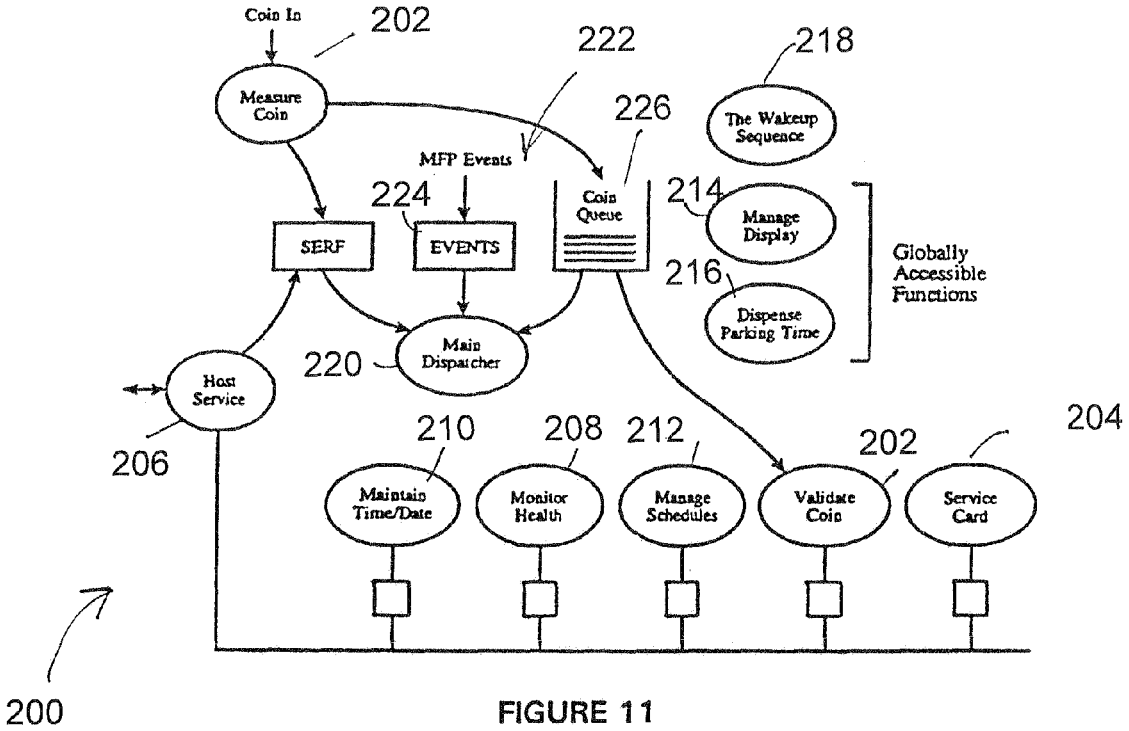
FIG. 11 is a circuit diagram of a software architecture according to the preferred embodiment of the present invention.

A top level partitioning, illustrated in FIG. 11, assigns each meter function to one of the following modules: SERVICE COIN, SERVICE CARD, SERVICE HOST, MONITOR HEALTH, MAINTAIN TIME/DATE, MANAGE SCHEDULES, MANAGE DISPLAY, and DISPENSE PARKING TIME. Supporting modules required to complete the architecture are: WAKE UP SEQUENCE and MAIN DISPATCHER Each of these modules is described below and accompanied by data flow and state diagrams where appropriate. The names used for modules, functions and data items are for descriptive purposes only. That is, they may not necessarily coincide with the implementation of the design. The architecture described here is not a functional specification of the meter of the present invention, but rather is derived from functional requirements. The architecture provides a framework into which the software design is implemented.

Wakeup Sequence

The Wakeup Sequence is a program which executes once per reset and is entered from startup code after a runtime environment has been established. Global data structures, such as the Event Table and the Coin Queue, must be initialized to their idle states, and are done so by calls to initialization functions in the MAIN DISPATCHER module.

The Watchdog Timer Flag (WDTF) is then read from the Initial Boot Program (IBP) data area, and, if non-zero, it is cleared and the respective event flag is set in the Event Table.

One initialization routine for each application module is called to perform any local initialization required. These would include resetting of state variables, installation of interrupt vectors and so on.

Finally, the master controller interrupt system is enabled and this program exits to the MAIN DISPATCHER.

Main Dispatcher

In each execution cycle, the MAIN DISPATCHER first reads the status registers of the Multi-Functional Peripheral (MFP) and writes these to the Event Table. Using the Event Table and the Coin Queue as input, the program dispatcher invokes each application task if its respective event is detected. It is the responsibility of the individual tasks to clear their respective events. When all events are serviced, this routine executes the power down sequence.

This module is the centre of scheduling activity and is an important component of the architecture, as it defines the priority scheme to be used. Event management is localized such that several design approaches to task scheduling can be realized without requiring changes to other modules.

Essentially, the program dispatcher must retrieve status registers from the Multi-Functional Peripheral (MFP) and write the individual event flags to the Event Table, monitor the Coin Queue for the non-empty status and invoke a service task for each detected event. How often these functions are executed and in what order will define their priority. The following is a list of events:

| | |
|---|---|
| SERF | Serial Port Event |
| SECF | Second Timer Event |
| DSPF | Display Event |
| CDIF | Card Detect Event |
| MTRF | Meter Event |
| ALMF | Alarm Clock Event |
| RESF | Reset Event |
| BATF | Battery Event |
| WDTF | WatchDog Timer Event |
| DAYC | Midnight Counter |
| COSM | Coin Queue Semaphore |

Service Host

This program is invoked via the MAIN DISPATCHER when the SERF event is asserted. SERVICE HOST provides the means of programming the meter with replacement software, setting its operating parameters and auditing its data tables. Communication with the external computer is via a half-duplex, asynchronous serial link. While executing, all other meter tasks are prevented from running. In other words, while the external computer is communicating via the serial input, the meter will not respond to other external inputs.

This program provides two categories of services. The first provides read and write access to the various internal databases and the second provides the interface to control functions in other system modules; for example, setting and reading the time of day clock.

As mentioned earlier, the proximity detect circuitry forms the physical link between the external computer and the meter. This circuitry is shared between the SERVICE HOST and SERVICE COIN modules in a mutually exclusive manner. SERVICE COIN samples the coin chute on a proximity detect event and, if no measurable coin is found, sets the SERF flag and leaves the proximity circuit idle. The SERF flag causes entry to the SERVICE HOST module from the MAIN DISPATCHER. Communications between the meter and the external computer proceeds as a master-slave relationship, with the meter as the master.

When the external device disconnects, by timeout or by message, the SERVICE HOST module clears the SERF event flag and deasserts the Proximity Inhibit output signal to thereby reactivate the proximity detect circuitry. The SERVICE HOST module then returns to the MAIN DISPATCHER.

Monitor Health

The Monitor Health Module encapsulates functions associated with determining the operational health of the meter. It provides as output, a flag which indicates the operational mode of the meter to other modules. Additionally, any required up-to-date status information and log of interesting events are recorded for read access by other modules, including the SERVICE HOST module.

Figure 12:
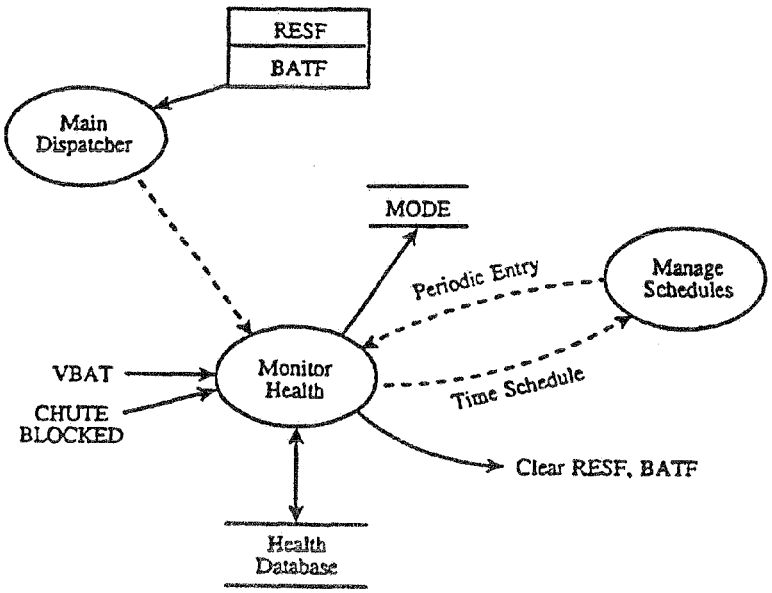
FIG. 12 is a circuit diagram of a monitor health data flow according to the preferred embodiment of the present invention.

With reference to FIG. 12, which is a data flow diagram, the main entry point of the module is called at periodic intervals to assess the status of the meter. This mechanism uses a service from the MANAGE SCHEDULES module. If required by design, a return call to this module, shown as the time schedule output, programs the time of the next periodic entry.

The MONITOR HEALTH module is also entered from the MAIN DISPATCHER on the occurrence of the RESF (system reset) and BATF (battery replacement) to record these events.

As a minimum, two input signals are provided to MONITOR HEALTH, as shown in FIG. 12 as VBAT and CHUTEBLOCKED. VBAT is a reading of the power supply voltage and is accessible via a software function which reads the respective channel of the A/D converter. CHUTEBLOCKED indicates an obstruction in the coin chute and is provided by a software function which executes the required sequence to obtain the reading. Each of these functions share hardware resources with the SERVICE COIN module. A suitable method of ensuring mutual exclusion (for example, masking the coin interrupt or use of a software semaphore) of these resources is necessary.

Maintain Time/Date

Management of the realtime clock is a distributed process. The time and date originate from the external computer and are transmitted to the meter via the serial link. Once the meter has set its time and date, the clock proceeds to run internally and is managed by this module. The Maintain Time/Date module uses the time of day clock of the MFP as a 24 hour time base and contains the necessary logic and data storage to maintain the calendar date and day-of-week.

Figure 13:
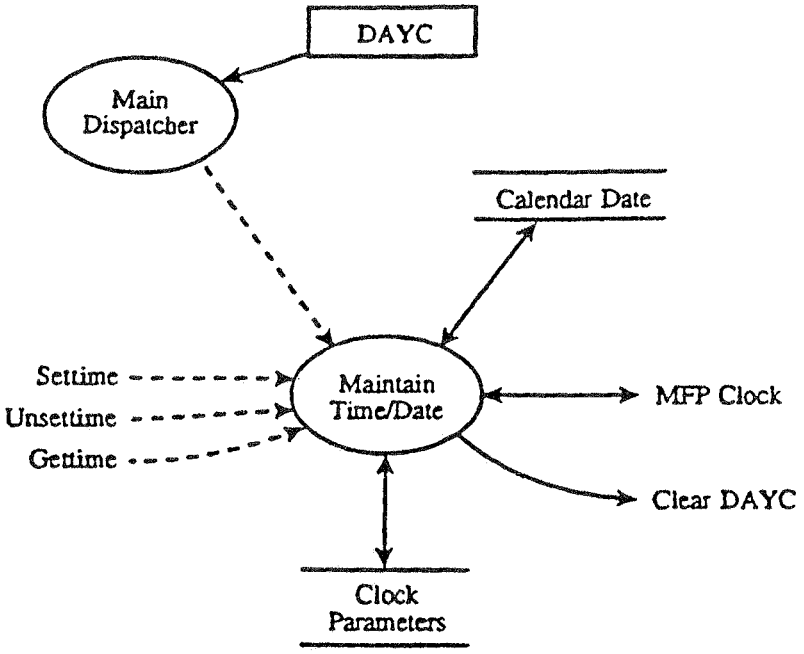
FIG. 13 is a circuit diagram of a maintain time/date data flow according to the preferred embodiment of the present invention.

The inputs and outputs of this module are shown in FIG. 13. The module contains at least four entry points, one which services the DAYC event (day rollover count) and is called from the MAIN DISPATCHER, and three functions which are accessible to other meter modules: settime, unsettime and gettime. Any other functions needed to translate between time formats used internally would be included in this module as well.

The settime function is typically called from SERVICE HOST on request from the external computer. The date information is separated and stored internally and the time information is used to set the time-of-day clock in the MFP. Also at this time, the DAYC event counter is cleared. Finally, after these steps are successfully completed, an internal flag is set, indicating that the realtime clock has been set.

The gettime function is a service to any module which wants to timestamp events. One example may be the timestamping of a smartcard to indicate its last usage. This function determines the validity of the realtime clock by checking the internal flag and returns an error condition or date/time as appropriate. The date is retrieved from internal storage; the time is retrieved from the MFP.

Unsettime provides the means of invalidating the realtime clock. One use of this function is during a recovery procedure where the state of the realtime clock is unknown.

The entry point which handles a non-zero DAYC event uses the value of DAYC to advance the calendar date. The event is cleared before exiting to the MAIN DISPATCHER by writing the respective status register on the MFP.

Manage Schedules

The Manage Schedules module is required to manage the scheduling of periodic activities for the meter. Two activities which require scheduling are health checks and the hours of operation for the meter. Any design which closely couples this module with the functions it services is an acceptable approach for a small set of activities. For larger sets, or where expansion considerations are an issue, a more appropriate approach would resemble a client-server model. In the latter approach, MANAGE SCHEDULES would provide a service for other modules (clients), invoking requested functions at the specified time and without knowledge of what the function is to do.

Figure 14:
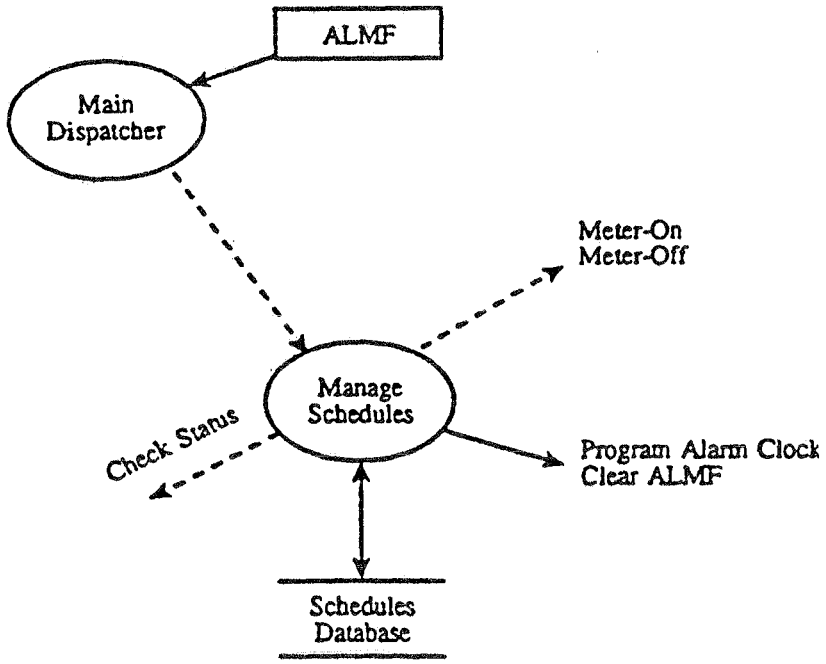
FIG. 14 is a circuit diagram of a manage schedules data flow according to the preferred embodiment of the present invention.

From an architectural perspective, the theory of operation of the module is the same and is represented by the data flow in FIG. 14. The main entry point is called from the MAIN DISPATCHER when the ALMF flag is set. The ALMF event indicates that the previously programmed alarm time matches the time-of-day clock. A state machine executing within the module determines and invokes the function or functions associated with the alarm time as indicated in the SCHEDULES database.

Status checks are invoked when required and the functions which activate/deactivate the DISPENSE METER TIME module are called according to the hours of operation. In completing the cycle, the system alarm clock is programmed to its next event in the schedule and the ALMF condition is cleared.

Service Coin

This module executes the functions required to detect a coin (or other object) in the chute, measure and discriminate the coin and apply the correct number of credits to purchased parking time.

Figure 15:
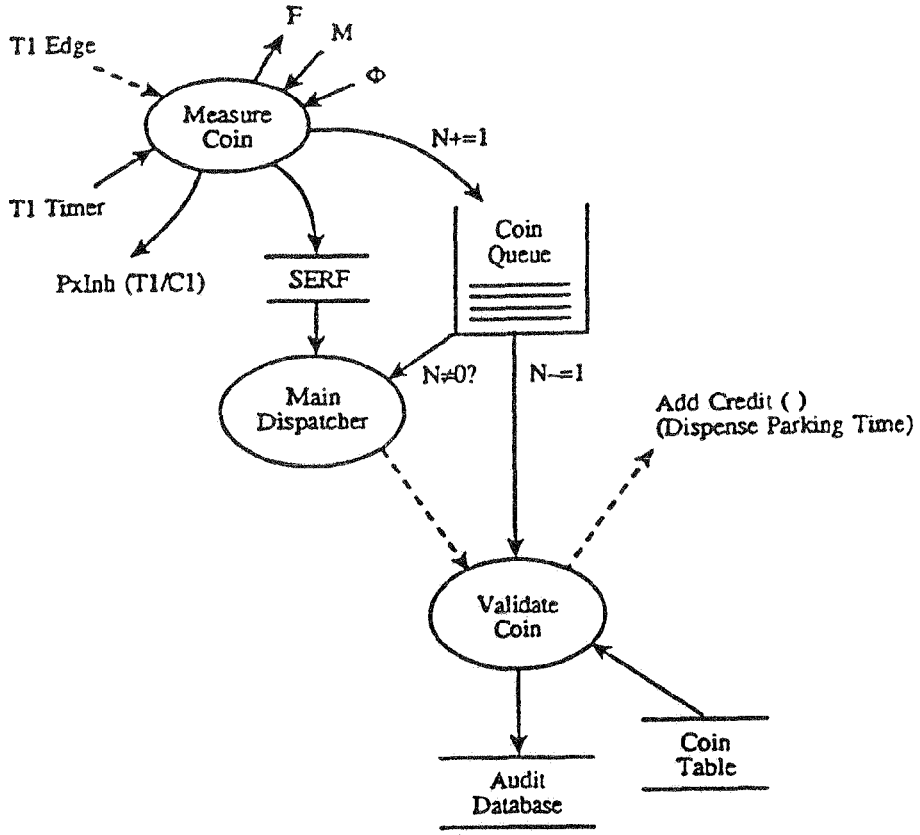
FIG. 15 is a circuit diagram of a service coin data flow according to the preferred embodiment of the present invention.

The SERVICE COIN module consists of two tasks, MEASURE COIN and VALIDATE COIN. MEASURE COIN executes in the context of an interrupt service routine (ISR). VALIDATE COIN executes at the non-interrupt level and is invoked by the MAIN DISPATCHER. MEASURE COIN is required at the interrupt level to provide deterministic response to proximity events, independent of which task is executing at the non-interrupt level. The interface between MEASURE COIN and VALIDATE COIN is the COIN QUEUE, shown in FIG. 15. The COIN QUEUE provides for the latency in scheduling the VALIDATE COIN task.

Each cycle of the MEASURE COIN task, invoked by a proximity event, posts the measured parameters to the COIN QUEUE. The MAIN DISPATCHER calls VALIDATE COIN when it detects that the COIN QUEUE is non-empty. VALIDATE COIN then de-queues and processes the event. These operations are discussed more fully in the following subsections.

Measure Coin

The coin measurement algorithm is effected using a balanced bridge circuit which can uniquely identify more than twenty different coins. That algorithm is used as the core of the Measure Coin ISR.

What remains to be implemented is the interface logic to the COIN QUEUE and the SERF flag, both monitored by the MAIN DISPATCHER, and the logic necessary to drive this function via the timer 1 Edge Detect Interrupt and Proximity Inhibit output signal.

Timer 1 operates in two modes, pulse width modulated output mode (PWM) and simple counter mode. Independent of these modes, the peripheral also provides edge detect circuitry as the source of interrupt (proximity detect) and an output bit port which supplies the Proximity Inhibit signal. Functions exist in ROM which provide the necessary interface to the Timer 1 peripheral.

Timer 1 is programmed to simple counter mode when the interrupt service routine is entered and to PWM mode upon exit.

The Proximity Inhibit output signal is asserted on ISR entry and deasserted on exit unless serial activity is detected.

The COIN QUEUE is posted with a queue element by this function with each successful measurement of a coin. A queue element contains the parameters necessary to discriminate the coin via the Coin Tables.

After each successful coin measurement, the CHUTE-BLOCK input should be checked for an obstruction in the coin chute and the module MONITOR HEALTH notified of an affirmative result.

MEASURE COIN handles unsuccessful coin measurements as follows:

1) Unexpected behaviour of the inputs are errors which may be recorded for diagnostic purposes.

2) Failure to obtain the coin characteristics within a predefined time interval is expected behaviour which indicates serial communications activity.

In the latter case, this function confirms serial port activity, sets the SERF flag and exits the interrupt service routine with the Proximity Inhibit output asserted.

Coin Queue

The COIN QUEUE is a FIFO (first-in, first-out) queue of sufficient depth to handle the number of coins which can be inserted in the worst case cycle time of the MAIN DISPATCHER. Each queue element is the frequency and magnitude readings of a single coin event.

Queue management is effected by three parameters, FILL POINTER, EMPTY POINTER and COUNTING SEMAPHORE. The FILL POINTER is stepped around the queue by the MEASURE COIN function with each successful reading. The EMPTY POINTER is stepped with each queue element removed from the queue by the VALIDATE COIN function. The COUNTING SEMAPHORE is a shared variable incremented by MEASURE COIN when an element is added to the COIN QUEUE and decremented by VALIDATE COIN when an element is removed. Because it is possible that the measure coin function may interrupt VALIDATE COIN processing, enqueuing and dequeuing operations must be uninterruptible to maintain the queue's integrity. To ensure these operations are uninterruptable:

1) the counting semaphore is an 8 bit variable in the master controller internal register file providing single CPU instruction access,
2) the MAIN DISPATCHER reads the semaphore to determine if the queue is non-empty, and
3) VALIDATE COIN must decrement the semaphore with the master controller "ADD #−1, Rx" instruction.

Validate Coin

VALIDATE COIN removes and processes elements from the COIN QUEUE when invoked from the, MAN DISPATCHER. For each element, a Frequency/Magnitude pair, a direct look up in the COIN TABLE determines the value of a coin in units of credits. A "miss" in the COIN TABLE and an answer of zero credits are handled as appropriate to the design. A non-zero answer from the COIN TABLE is passed directly to the DISPENSE PARKING TIME module via the function Add Credits. VALIDATE COIN also maintains an Audit Database for recording the coins deposited in the meter. For auditing purposes, this database is accessible to the SERVICE HOST module.

Service Card

Figure 16:
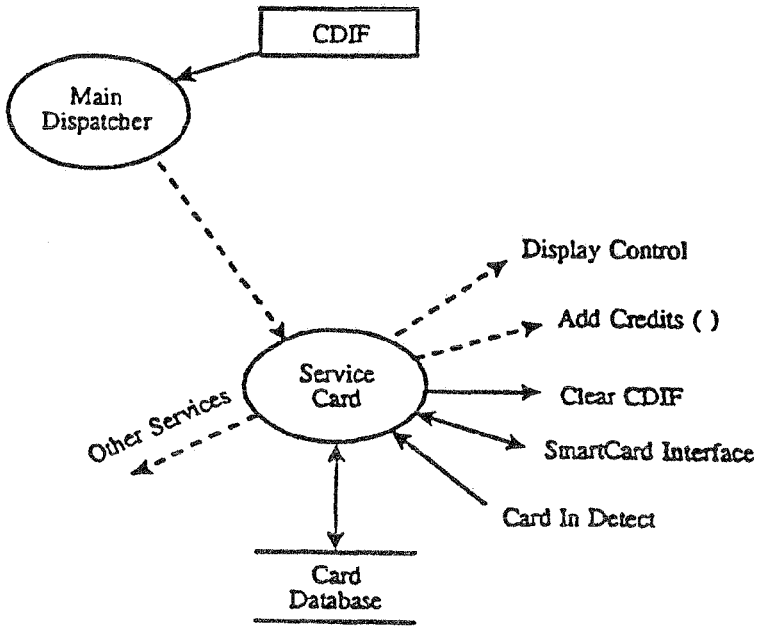
FIG. 16 is a circuit diagram of a service card data flow according to the preferred embodiment of the present invention.

The SERVICE CARD module provides the functionality necessary to support cash value and non-cash value cards via the smartcard reader. FIG. 16 provides a data flow diagram for this module. The main entry point of this module is called from the MAIN DISPATCHER when the CDIF flag is set, indicating a card has been inserted into the card slot. Any requirement to parametrically drive the response of the meter to a specific card is provided for in a CARD DATABASE which is accessible to SERVICE HOST.

SERVICE CARD authenticates, validates and employs any required encryption/decryption algorithms necessary to meet security requirements. Cash value cards invoke the Add Credits function of DISPENSE PARKING TIME and may invoke display control functions of MANAGE DISPLAY. Non-cash value cards may be supported for diagnostic, supervisory, auditing or other purposes by direct function calls from this module to other meter modules.

Should a card be unexpectedly removed from the reader, the architecture facilitates realtime responsiveness with the mechanical card-detect signal connected to a master controller external interrupt pin (INT2). This module executes the purchase of parking time from the meter.

Figure 17:
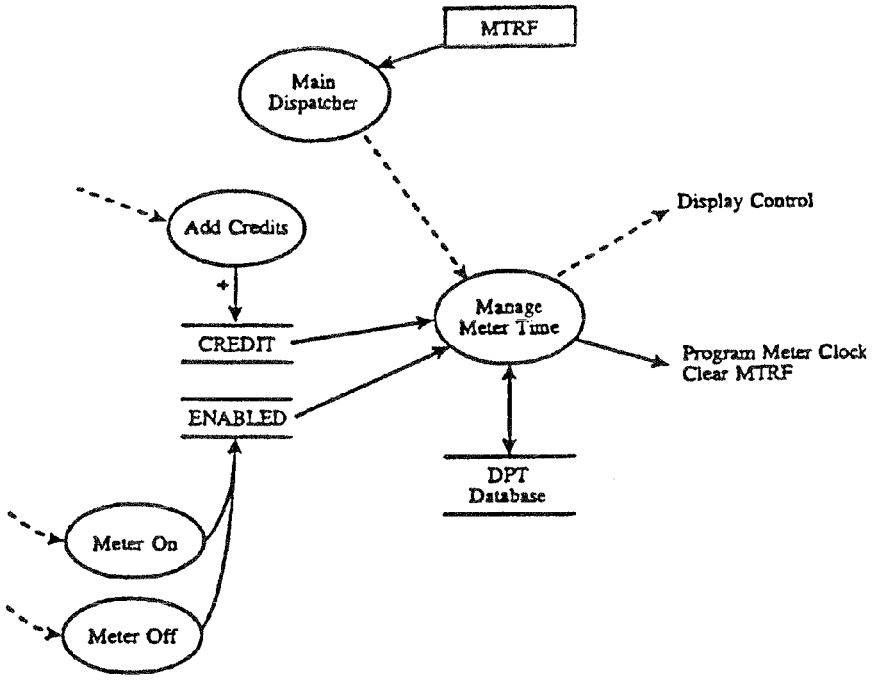
FIG. 17 is a circuit diagram of a dispense parking time data flow according to the preferred embodiment of the present invention.

Top level partitioning is shown in FIG. 17, which illustrates the data flows among four key functions and two key data variables. The data is defined as follows.

The ENABLED flag indicates the ability of meter to accept payment for purchased time. It is written by the MeterOn and MeterOff functions and read by MANAGE METER TIME. CREDIT is a buffer which retains an account balance. It is written by the AddCredits function and may be cleared by the MeterOn, MeterOff and MANAGE METER TIME functions. The account balance is credited on each call to AddCredits (typically from SERVICE COIN and SERVICE CARD). Crediting the account may depend on the ENABLED flag as dictated by design or by parameters in the DPT Database. For example, some meters may be programmed to accumulate credits while ENABLED is false, while others may ignore the request. Once the minimum number of credits are accumulated, purchased time is dispensed.

The functions MeterOn and MeterOff are provided as input control to setting and clearing the ENABLED flag. Again, the disposition of the CREDIT balance at the time of transitioning the ENABLED flag is a function of the design.

MANAGE METER TIME is a set of functions which execute a preprogrammed sequence of events in dispensing the purchased time. The main entry point is called from the MAIN DISPATCHER when the MTRF flag is detected (indicating meter time expired). In the course of execution, MANAGE METER TIME controls the alphanumeric and enunciator LCD via calls to MANAGE DISPLAY.

The functions which make up this module are cooperative and the behaviour of the module at any instant depends on a history of events. Therefore, these functions execute as a software state machine. The inputs of the state machine are CREDIT, ENABLED, MTRF and the DPT Database. The outputs are its programming of the meter clock and control of the display. The states are a function of the design and/or parameters stored in the DPT Database. In fact, how the inputs are interpreted and what is included as output may be parametrically driven by the DPT Database, as well. In other words, the state machine may be programmed in the logic (software), in the DPT Database (parametrically done) or some combination of these.

For illustrative purposes, a sample implementation is depicted in the state diagram of FIG. 2. This implementation is a three-state machine which has an IDLE state (no time purchased), a PURCHASED state (purchased time remains) and a GRACE state (which permits some non-purchased time before a violation is issued). IDLE state is entered from system reset and a default message is output to the display.

IDLE transitions to PURCHASED state when ENABLED and CREDITS have been applied. The purchased time is output to the display. The meter remains in PURCHASED state while credits are applied to the account and transitions to GRACE state when the purchased time expires (indicated by MTRF).

GRACE state reverts to PURCHASED state when additional credits are applied or to IDLE state when the GRACE period expires. GRACE and PURCHASED states exit to IDLE state whenever the ENABLED flag becomes false.

Manage Display

Figure 18:
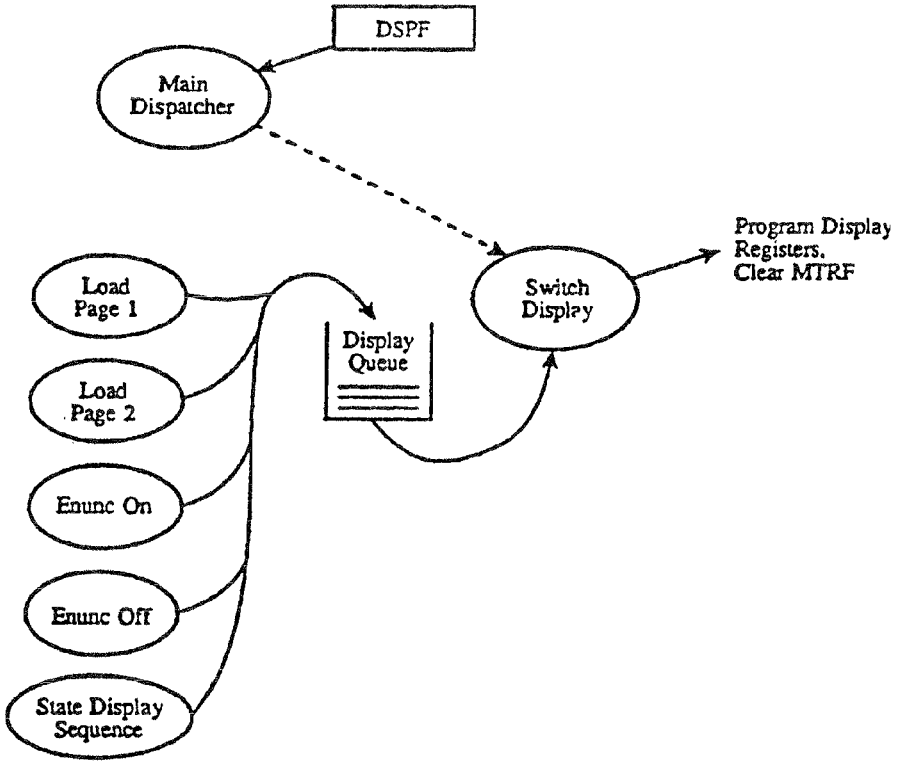
FIG. 18 is a circuit diagram of a manage display data flow according to the preferred embodiment of the present invention.

Control of the alphanumeric and enunciator LCDs are effected through library routines within the Manage Display module and are provided as a resource to all meter modules. FIG. 18 illustrates a minimal design requirement and it is expected that additional functions will be specified by the design.

The SWITCH DISPLAY entry point from the MAIN DISPATCHER (invoked when the period of the current display has expired) provides for displaying a default message (when there is no other display defined) or for implementing queued output if a requirement for this exists. The DISPLAY QUEUE is included in FIG. 18 for this requirement and if queued output is not required, the DISPLAY QUEUE has zero depth. As specified here, the architecture provides control of the display to one or many processes (modules) at one time. The key point is that display requirements are not an architectural issue but a function of the design concept and are constrained only by the MFP's display capability.

Initial Boot ROM

The Initial Boot ROM is the system residing in master controller mask ROM which provides initial boot and reset functions for the meter. The following description describes the Reset module, the Boot Loader, the runtime environment established by the Reset Module and is inherited by the application program and the callable functions which exist in the mask ROM.

Reset Module

This module consists of the logic and data requirements to launch the execution of an application program. It is entered immediately upon reset of the master controller. The Reset Module is responsible for initializing system specific hardware, determining the existence of application software (executing the boot loader, if necessary) and establishing the runtime environment before passing control to the application program.

Figure 19:
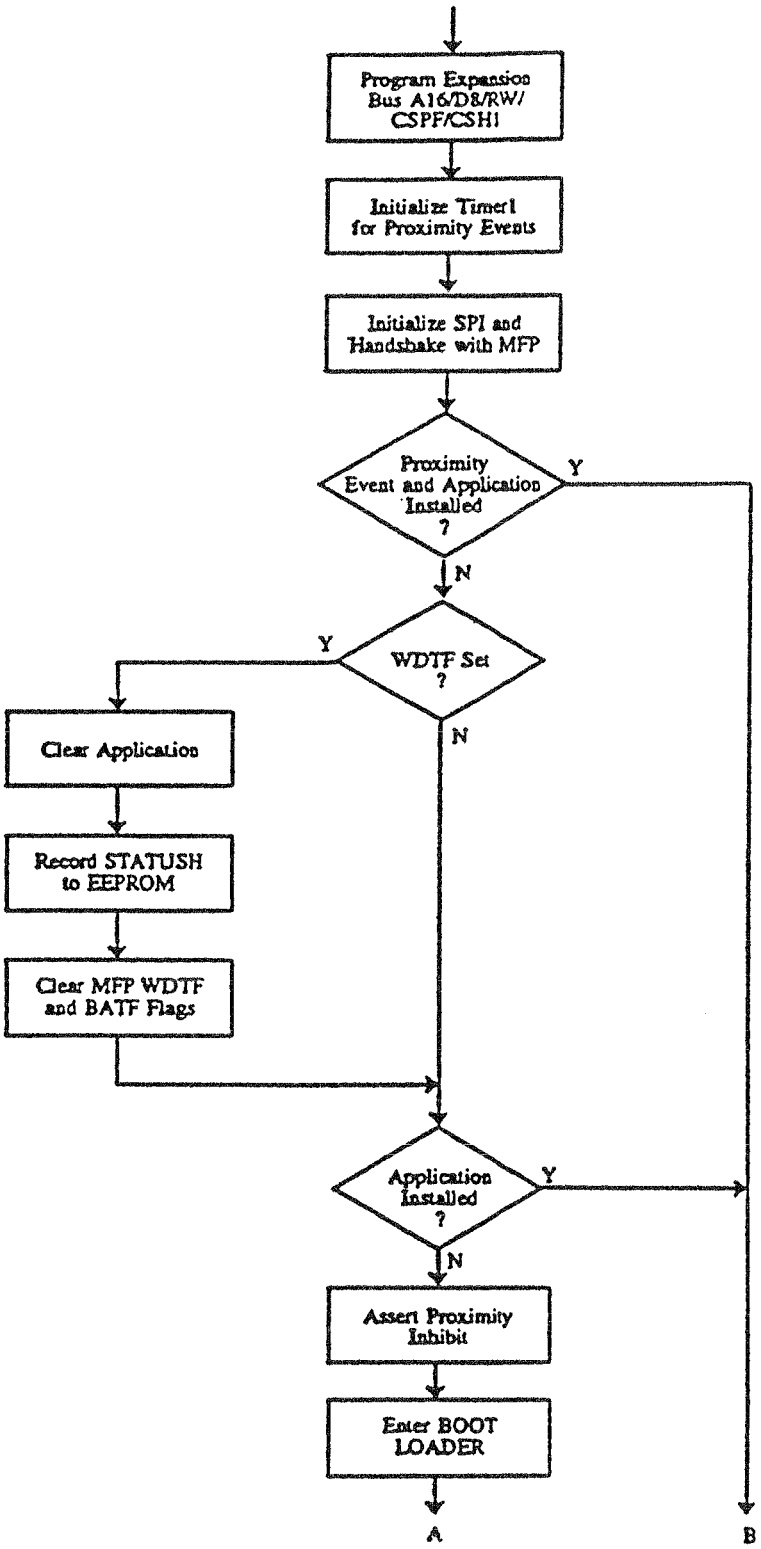
FIG. 19 is a circuit diagram of a reset flow chart according to the preferred embodiment of the present invention.
Figure 19:
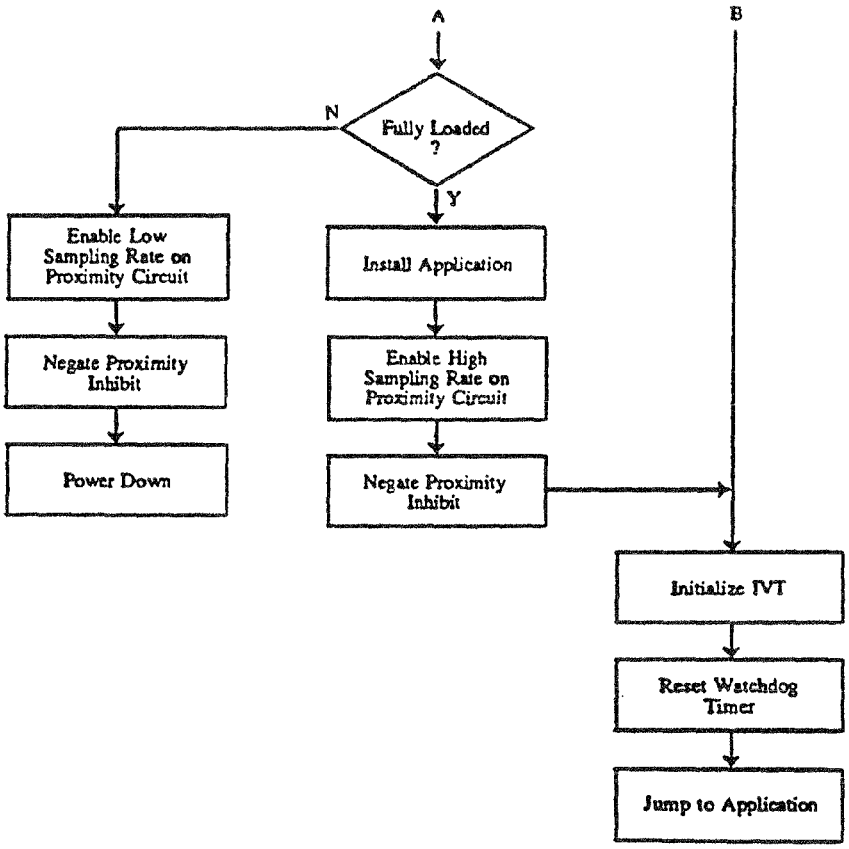

The design of this module is represented in the flow chart of FIG. 19 and described as follows. The Reset Module first programs the master controller external ports as the system bus interface, enabling 16 address lines, 8 data lines, the read/write line and two chip select lines. Next, the TIMER1 module is initialized to capture proximity circuit events and a handshake is performed with the MFP, enabling communications with this device via the Serial Peripheral Interface (SPI).

A TIMER1 peripheral is then checked to determine if the master controller reset was caused by a proximity event. If this is the case, and an application program exists in EEPROM memory, control is passed to the application via the procedure indicated at the bottom of the flow chart.

Failing this test, if the WDTF (watchdog timer flag) is set, the existing application program is cleared (by zeroing the Application Version Number in EEPROM). The module then passes control to the application if one is installed. Otherwise, it disables the proximity detect logic (enabling Serial Communications Interface (SCI) communications) and enters the boot loader to obtain a software download.

If the boot loader is unsuccessful in capturing the download, the proximity circuit is re-enabled and the master controller is powered down. When the communications probe is reinserted in the mouth of the coin chute, the master controller is powered and execution restarts at the Reset Module's entry point.

A successful download is installed by writing the point address and version number of the application to the EEPROM. The proximity circuit is enabled and control is passed to the application.

The final steps executed by the Reset Module before exiting to the application require that the IVT in RAM memory be defaulted to a known state and the watchdog timer reset.

Boot Loader

Figure 20:
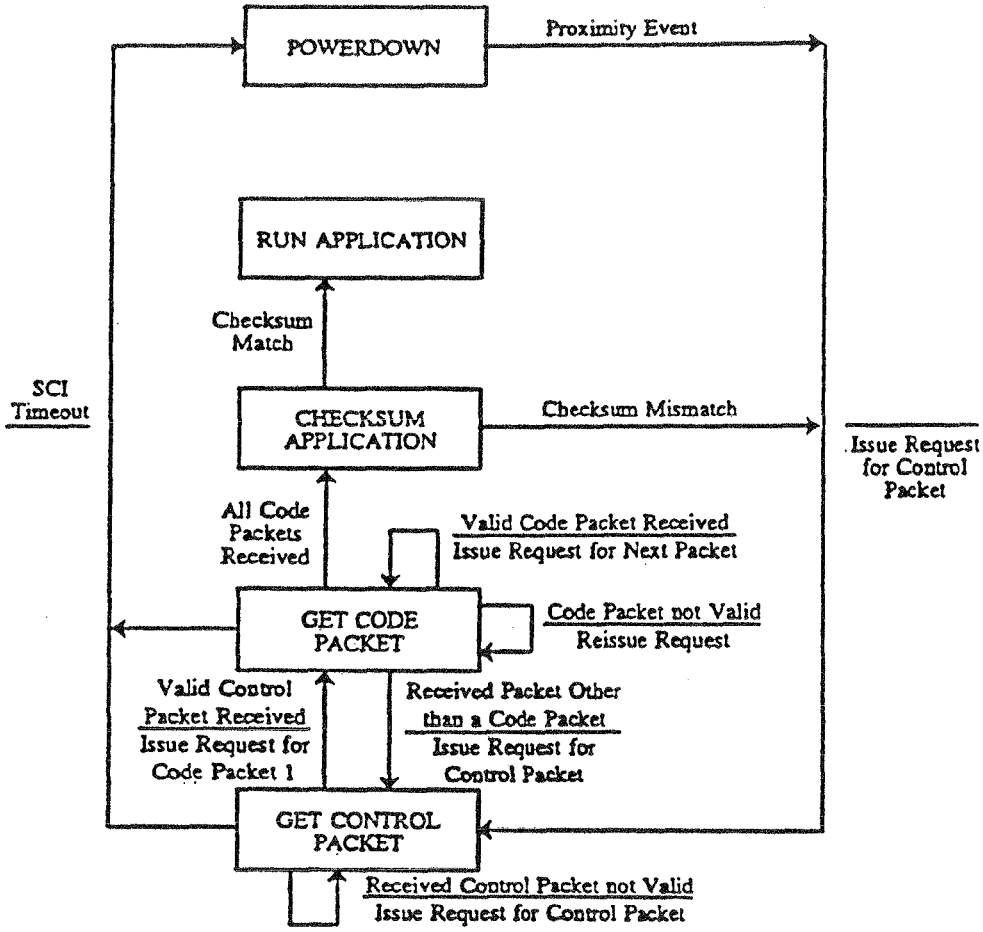
FIG. 20 is a circuit diagram of a boot loader state diagram according to the preferred embodiment of the present invention.

The Boot Loader provides for downline loading of application programs via the serial communications interface (SCI). The Boot Loader operates as the state machine represented in FIG. 20. The following description refers to this figure.

The Boot Loader enters the GET CONTROL PACKET state when the master controller is powered without application software. This state begins the loading procedure. It is entered, as well, from other states when fatal loading errors occur. When an error-free control packet is received, it transitions to the GET CODE PACKET state.

In this state, the BOOT LOADER requests each code packet from the host, incrementing the packet count when error-free transmissions are received. If a code packet contains an invalid field or fails the packet's checksum protection, the Boot Loader simply reissues the request. If an unexpected packet is received (anything other than a code packet), the Boot Loader reverts to the GET CONTROL PACKET state.

When all code packets are received, state CHECKSUM APPLICATION is entered and a longitudinal data check of all code packets is performed. A checksum mismatch at this point, reverts to the GET CONTROL PACKET state. If the checksum test passes, the application software is validated and executed, completing the loading procedure.

In the GET CONTROL PACKET and GET CODE PACKET states, the Boot Loader maintains an intercharacter timer to detect link inactivity. When a timeout condition occurs, the request is reissued up to a maximum retry count of four for the GET CONTROL PACKET state, and two for the GET CODE PACKET state. When the maximum number of retries are exhausted, the Boot Loader indicates failure to the Reset Module, causing an orderly powerdown of the master controller.

Proximity Detect

Figure 21:
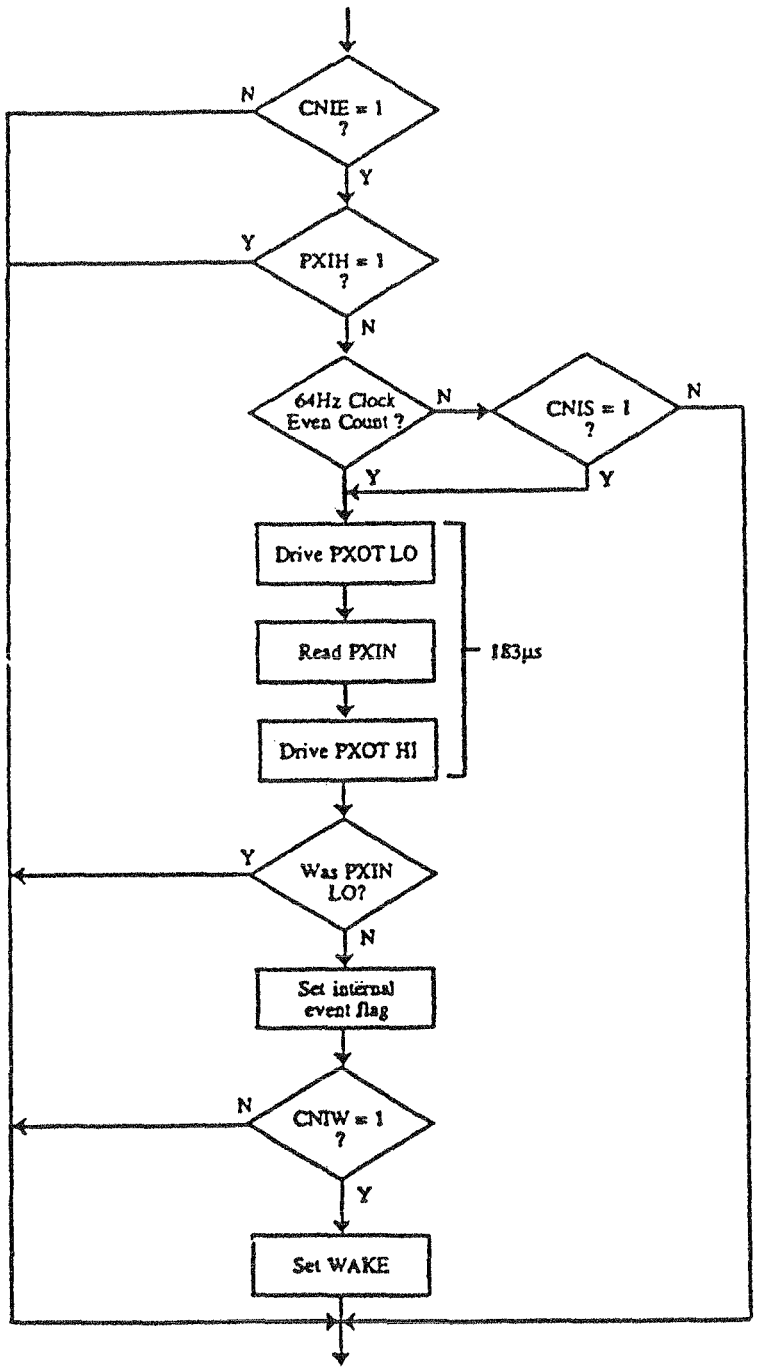
FIG. 21 is a circuit diagram of a proximity detect according to the preferred embodiment of the present invention.

The proximity detect function executes in 64 Hz interrupt service, while battery conditions are favourable and the host's watchdog timer has not expired twice consecutively. The flow chart in FIG. 21 describes its logic.

Host Power Sequences and the Watchdog Timer

The power sequences described below are executed only while battery conditions are favourable and the host watchdog timer has not expired twice consecutively.

Figure 22:
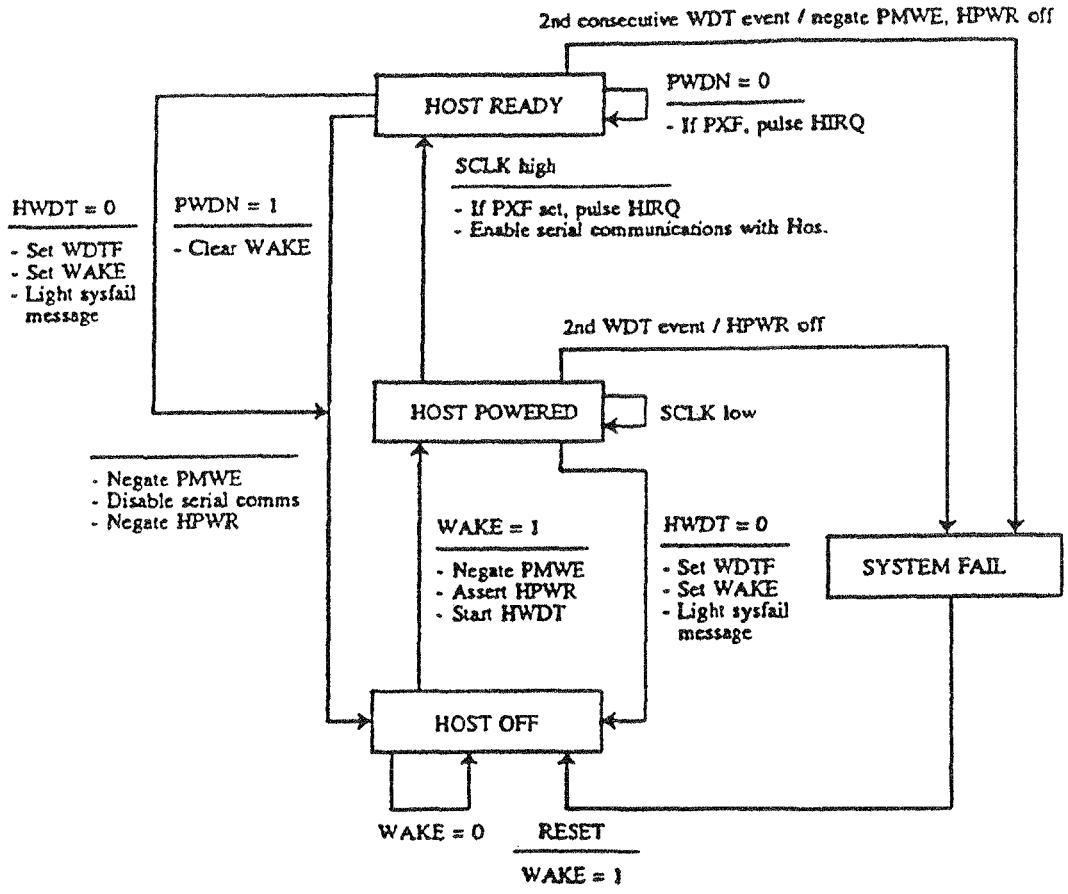
FIG. 22 is a circuit diagram of a host power state machine according to the preferred embodiment of the present invention.

The sequences are executed in the transitions of a four-state machine located entirely within the 64 Hz interrupt service. The states are HOST OFF, HOST POWERED, HOST READY and SYSTEM FAIL as shown in the state diagram in FIG. 22.

The MFP remains in HOST OFF state until an internal event causes the WAKE flag to be set. Then, the PMWE output is negated, HPWR is asserted and the host's 4 second watchdog timer is started. The MFP then remains in HOST POWERED state until SCLK, the host's serial communications clock, becomes active or watchdog timer expires. When SCLK is detected, HOST POWERED state exits to HOST READY. This transition enables serial communications and asserts the host's interrupt if PXF (proximity event) is set.

The MFP remains in HOST READY state while HWDT is nonzero and PWDN is zero (host has not requested power off). When one of these conditions is true, HOST READY exits to HOST OFF, unless this is the second HWDT event, in which case SYSTEM FAIL is entered. In the case of the first HWDT event, the WDTF flag and the internal WAKE flag are set. If the PWDN bit is set, the internal WAKE flag is cleared. The transition is completed by negating PMWE program (memory write enable), disabling serial communications and turning off the host's power.

The SYSTEM FAIL state is entered from HOST POWERED state and from HOST READY state on the occurrence of the second consecutive watchdog event. The only exit from SYSTEM FAIL state is system reset.

Power on Sequence

Figure 23:
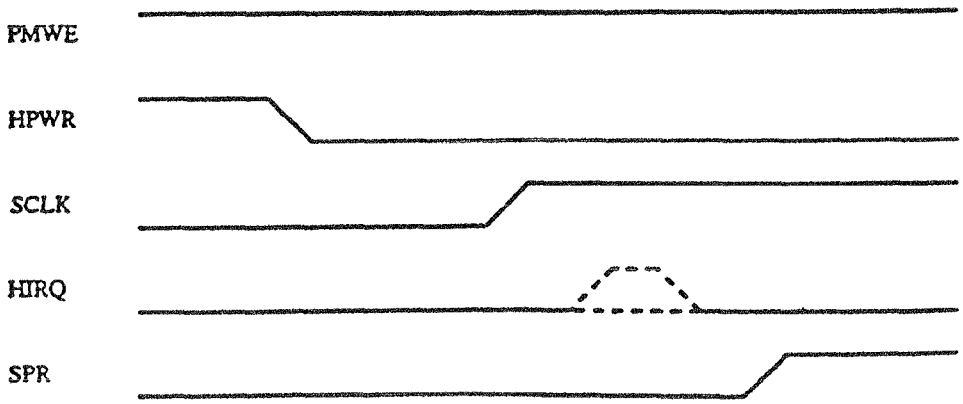
FIG. 23 is a circuit diagram of a power on sequence according to the preferred embodiment of the present invention.

The timing diagram in FIG. 23 shows the external events which occur when the MFP transitions from HOST OFF to HOST READY. The MFP asserts HPWR and waits for SCLK. The nut prepares for the HIRQ event and then initializes the serial interface, asserting SCLK. The host then waits for SPR to be asserted.

When SCLK is detected by the MFP, HIRQ is pulsed if a proximity event was detected and the watchdog timer event is false. Finally, the MFP's serial peripheral is initialized, asserting SPR.

Power Down Sequence

Figure 24:
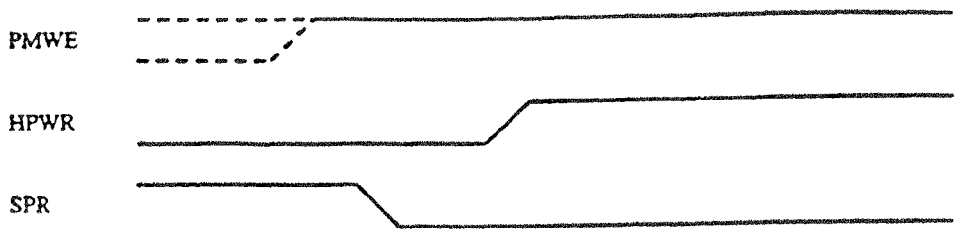
FIG. 24 is a circuit diagram of a power down sequence according to the preferred embodiment of the present invention.

The power down sequence is shown in the timing diagram in FIG. 24.

Card Detect

Figure 25:
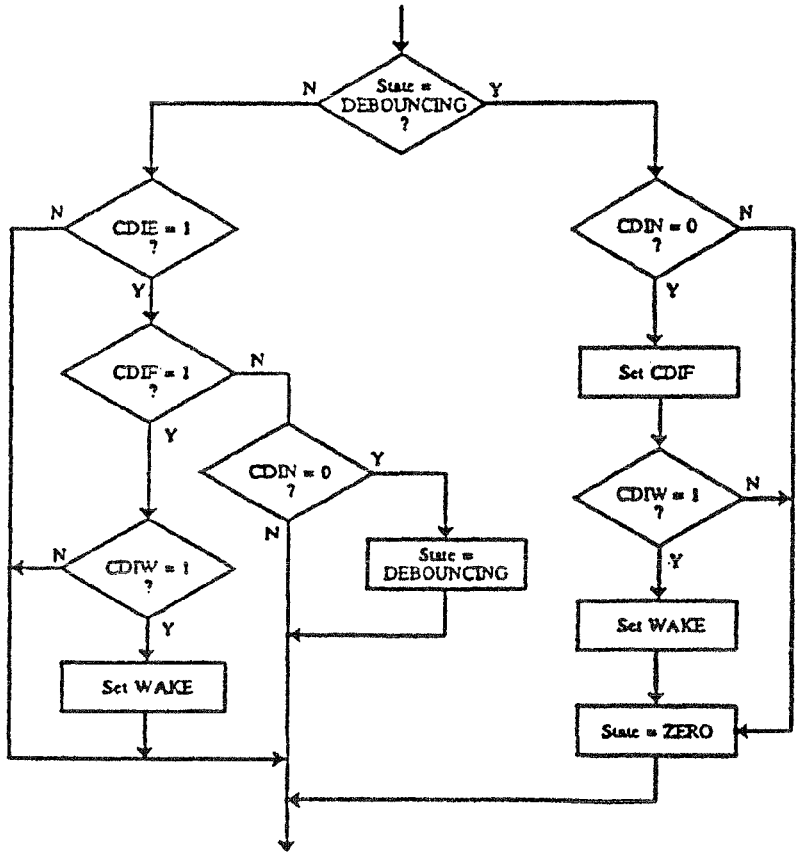
FIG. 25 is a circuit diagram of a card detect according to the preferred embodiment of the present invention.

The card detection algorithm executes in a 4 Hz interrupt service. It consists of a simple two-state machine, with states ZERO and DEBOUNCING. The flow chart in FIG. 25 describes the logic executed.

Static LCD/GPIO Driver

The MFP implements four bit ports which are independently programmed by the host as static LCD drivers, general purpose output or general purpose input. The logic which implements these configurations is distributed among three cooperating subfunctions in the HOST, DDVR and X64I modules.

The process is shown in the data flow diagram in FIG. 28. Essential to the operation are the two intermediate 4 bit registers, X0-FCT and X0-SSG. These registers are read-only registers to an X64I module, and logically combine along with the state of the static backplane signal, to produce the state of each bit port.

When an X0-FCT bit is 0, its respective bit port is an 10 port and its state is defined in X0-SSG (if an output) or in the bit port itself (if an input). DDVR intervenes and defines the instantaneous state of the X0-SSG bits which are programmed as LCD segments (X0-FCT=1) according to the state requested by the host and the count registered in the 4 Hz clock.

The HOST module is responsible for the uninterruptable update of the X0-FCT register, the X0-SSG bits which are defined as GPIO and the configuration of each bit port each time registers SS0 through SS3 are written by the host.

LED Driver

The LED driver implements one of 4 states, OFF, ON, 1 Hz and 0.5 Hz, for each of 2 LEDS as specified by the host. Two, 2-bit fields are defined in an E9LED register for this purpose.

The LED driver is executed in the 4 Hz interrupt service and is entered when WDTF and BATF flags are clear and the 4 Hz clock is modulo 4; ensuring that LED pulses are synchronous with the 1 second mark. Because the bit ports which drive LEDs 0 and 1 are shared with two unrelated output signals, the LED driver prepares a mask and sets the LED bit ports appropriately while preserving the state of the other signals. After approximately 18 ms, the LED bit ports are cleared (unless state ON is programmed), turning both LEDs off.

Battery Detect

Figure 26:
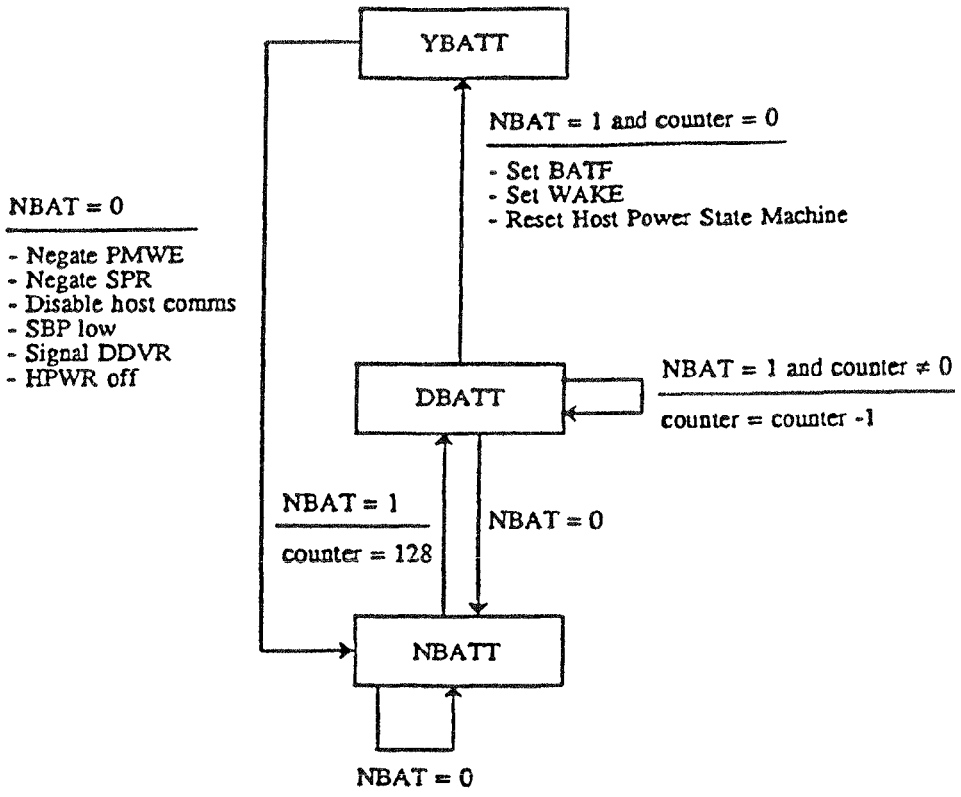
FIG. 26 is a circuit diagram of a battery detect state machine according to the preferred embodiment of the present invention.

The MFP monitors a battery detect input signal (NBAT) at a 64 Hz rate, and implements the state machine shown in FIG. 26. As shown, there are three states: YBATT (battery present), NBATT (battery not present), and DBATT which is a transitional state, debouncing the NBAT signal when a battery is being inserted. The default (reset) state of the MFP is YBATT state.

YBATT is exited to NBATT state when the NBAT signal is asserted. In exiting the YBATT state, the MFP disables PMWE (Program Memory Write Enable), disables SPR (Serial Peripheral Ready) and disables communications with the host, turns off both LEDS, drives the static backplane and static LCD/GPIO pins to a high state, displays the system fail message (dashes) and the BATTERY indicator and finally turns off the power supply to the host.

The MFP remains in NBATT state while the NBAT input signal is asserted. When NBAT logic high level is detected, a local counter is loaded with 128, and NBATT state is exited to DBATT state.

In the DBATT state, the counter is decremented each time the state machine is clocked and the NBAT signal remains high. When the counter has exhausted, after 2.0 seconds of NBAT high, DBATT is exited to YBATT state. In this transition, the BATF event flag is set, the internal WAKE flag is set (enabling a host wakeup call), and the Host Power State Engine is set to OFF state. While in the DBATT state, any reading of NBAT low causes transition to the NBATT state.

The state machine described above executes within the X64I module. The remaining functionality required is implemented in the DDVR HOST FAIL state machine, which services both loss of battery and watchdog timeout events.

Figure 27:
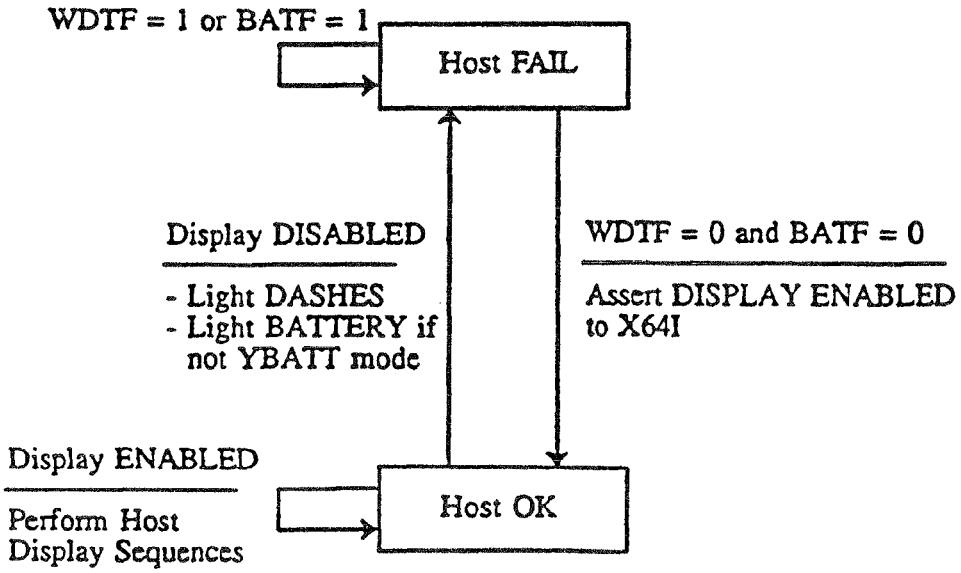
FIG. 27 is a circuit diagram of a display enabled state machine according to the preferred embodiment of the present invention.

As shown in the FIG. 27, this state machine completes the sequence required of entry to NBATT state from YBATT state. From the HOST OK state, detection of DISPLAY DISABLED signal from X64I transitions to the HOST FAIL state. In this transition, dashes (LCD segments g and k) are written in the LCD characters, and the BATTERY indicator is lit if the battery state is other than YBATT. DDVR remains in this state while either WDTF or BATF flags are set. When both WDTF and BATF are clear, a DISPLAY ENABLED signal is sent to X64I and HOST OK state is entered.

The embodiments of the invention in which an exclusive property of privilege is claimed are defined as follows:

1. A proximity detector for detecting the presence of a coin or token in a coin chute comprising:

a first oscillator circuit having a first coil and a first capacitor;

a second oscillator circuit having a second coil and a second capacitor;

said first and second oscillator circuits being inductively coupled;

said coils and said capacitors having substantially the same values;

said coils being axially aligned with one another and being disposed on opposite sides of said coin chute;

a common-emitter amplifier having a base and a collector, said collector providing a detector output, one of said first and second coils being connected to said collector and the other of said first and second coils being connected to said base.

2. A proximity detector as claimed in claim 1, further comprising a driving circuit for sampling a coin detect signal at a predetermined interval and initiating a coin validation and denomination measurement sequence.

3. A proximity detector as in claim 1, wherein said oscillator circuits comprise a transistor having a first tuned circuit connected to the base and a second tuned circuit connected to the collector.

4. A proximity detector as in claim 3, wherein said first tuned circuit and said second tuned circuit are slightly detuned for accelerating the starting-up of the oscillator circuits.

5. A parking meter, comprising:

a display;

a power supply for providing a voltage or current at a first low power level, and a second higher power level;

a coin chute for receiving a coin or token;

an object detector for detecting the presence of an object in said coin chute and generating an object detected signal upon detecting an object in said chute;

a coin discriminator for providing signals for use in identifying a coin or token inserted in said coin chute; and a first controller;

a second controller;

said first controller operable under said first power level and said second power level in an active mode for operating said display, and monitoring said object detector and generating a wake signal upon detecting said object detected signal;

said second controller having a normal, quiescent mode in which said second controller is disconnected from said second power level and an active mode in which said second controller is connected to said second power level and being transferable from said quiescent mode to said active mode in response to said wake signal.

6. A parking meter as defined in claim 5, further including external memory for storing programs and data accessible by said second controller.

7. A parking meter as defined in claim 6, said second controller including means for receiving a new operating program, storing said program in said memory and operating said new operating program.

8. A parking meter as defined in claim 5, further including serial interface means connecting said first controller and said second controller for use in exchanging data between said first and second controllers.

9. A parking meter as defined in claim 5, further including first oscillator means connected to said first controller and second oscillator means connected to said second controller.

10. A parking meter as defined in claim 9, said second oscillator means being disabled during said quiescent state of said second controller.

11. A parking meter as defined in claim 9, said first controller being operable at a first frequency during said quiescent state of said second controller and at a second higher frequency during said active state of said second controller.

12. A parking meter as defined in claim 5, each said first and second controllers having internal read only memory for controlling bootload operations.

13. A parking meter as defined in claim 5, said object detector being further operable to receive RF signals and transmit received RF signals to said second controller and receive signals from said second controller and transmit digital signals as RF signals.

14. A parking meter, comprising:

a display;

a power supply for providing a voltage or current at a first low power level and a second higher power level;

a coin chute for receiving a coin or token;

a card slot for receiving a card;

an infrared receiver and an infrared transmitter;

an object detector for detecting the presence of an object in said coin chute and generating an object detected signal upon detecting an object in said chute;

a card detector for detecting the presence of a card in said card slot and generating a card detected signal upon detecting a card in said card slot;

a coin discriminator for providing signals for use in identifying a coin or token inserted in said coin chute; and a first and a second controller;

said first controller operable under said first power level and said second power level in an active mode for operating said display, and for: (i) monitoring said object detector and generating a wake signal upon detecting said object detected signal; (ii) monitoring said card detector and generating a wake signal upon detecting said card detected signal; or (iii) monitoring said IR receiver and generating a wake signal upon detecting a signal thereat;

said second controller having a normal, quiescent mode in which said second controller is disconnected from said second power level and an active mode in which said second controller is connected to said second power level and being transferable from said quiescent mode to said active mode in response to said wake signal.

15. An apparatus for use with a device having a payment slot, the apparatus comprising:

means for reading digital data concerning activity of said device having a payment slot; and, means for communicating between said means for reading data and the device having a payment slot, said means for communicating comprising sensing means for insertion into the payment device receiving slot in the device having a payment slot.

16. The apparatus as defined in claim 15 wherein said means for communicating comprises a portable apparatus and a probe adapted to engage the device having a payment slot.

17. The apparatus as defined in claim 16 wherein said probe comprises a card provided with electrical contacts for engaging the payment slot.

18. The apparatus as defined in claim 16 wherein said probe comprises means for optically communicating with the device having a payment slot.

19. The apparatus as defined in claim 18 wherein said means for optically communicating with the device having a payment slot comprises an LED for transmitting information to the device having a payment slot and a sensor for receiving information optically transmitted by the device having a payment slot.

20. The apparatus as defined in claim 18, wherein said means for optically communicating with the device having a payment slot comprises an LED for transmitting information to the device and a sensor for receiving information optically transmitted by the device.

21. An apparatus for use with a parking meter comprising an internal circuit and a card receiving slot for accepting payment, said apparatus comprising:

means for exchanging digital data concerning activity of said parking meter; and, a means for communicating between said means for exchanging data and the parking meter, said means for communicating comprising card means for insertion into the card payment receiving slot, said card means comprising means for establishing electrical contact with the meter circuit.

22. The apparatus as defined in claim 21 wherein said means for communicating comprises a portable apparatus and a probe adapted to engage the parking meter.

23. The apparatus as defined in claim 22 wherein said card means projects from said probe.

24. An apparatus for use with a parking meter comprising an internal circuit and a coin receiving slot for accepting payment; said apparatus comprising:

means for exchanging digital data concerning activity of said parking meter; and, means for communicating between said means for exchanging data and the parking meter, said means for communicating comprising coin slot means for insertion into the coin payment receiving slot, said coin slot means comprising means for establishing electrical contact with the meter circuit.

25. The apparatus as defined in claim 24 wherein said means for communicating comprises a portable apparatus and a probe adapted to engage the parking meter.

26. An apparatus for use with a parking meter having a payment slot, said apparatus comprising:

a hand-held computer for collecting information from said parking meter concerning activity of said parking meter;

electrical contacts, electrically connected to said hand-held computer, through which information may be sent and received;

wherein said electrical contacts may be inserted into said payment slot in such a manner that said hand-held computer may communicate with said parking meter through said electrical contacts.

27. The apparatus of claim 26, wherein said electrical contacts are located on a probe which can be inserted into said payment slot.

28. The apparatus of claim 26, wherein said payment slot comprises a slot for accepting smart cards.

29. An apparatus for use with a parking meter having a payment slot, said apparatus comprising:

a hand-held computer for collecting information from said parking meter concerning activity of said parking meter;

an optical communication device, electrically connected to said hand-held computer, through which information may be sent and received;

wherein said optical communication device may be inserted into said payment slot in such a manner that said hand-held computer may communicate with said parking meter through said optical communication device.

30. The apparatus of claim 29, wherein said optical communication device comprises a probe having a short-range infrared transmitter and a short-range phototransistor.

31. The apparatus of claim 29, wherein said payment slot is for the receipt of coins.

32. The apparatus of claim 29, wherein said payment slot is for accepting smart cards.

33. A method of communicating with a parking meter concerning activity of said parking meter, comprising inserting an apparatus into a payment slot in the parking meter and transmitting information to and receiving information from said parking meter through said apparatus.

34. The method of claim 33, wherein said payment slot is for the receipt of coins.

35. The method of claim 33, wherein said payment slot is for the receipt of a smart card.

36. The method of claim 33, wherein said apparatus comprises electrical contacts for the transfer of information.

37. The method of claim 33, wherein said apparatus comprises a probe having a short-range infrared transmitter and a short-range phototransistor.

38. An apparatus for use with a parking meter comprising an internal circuit and a coin receiving slot for accepting payment; said apparatus comprising:

means for exchanging digital data concerning activity of said parking meter; and, means for communicating between said means for exchanging data and the parking meter, said means for communicating comprising insertion means for insertion into the coin receiving slot in the parking meter, said insertion means comprising means for establishing electrical contact with the meter circuit.

39. A method of communicating with a parking meter concerning activity of said parking meter, comprising inserting a communication device into a payment slot in the parking meter and transmitting information to and receiving information from said parking meter through said communication device.

40. A method of RF communication for a parking meter comprising: placing a radio frequency (RF) device in close proximity to at said parking meter; and, transmitting RF signals to said RF device and receiving RF signals from said RF device.

41. The method of claim 40, wherein said RF device comprises a circuit board substrate.

42. The method of claim 40, wherein said RF communication is provided as a half duplex communication.

43. The method of claim 40, further comprising modulating data on said RF signals transmitted to said RF device.

44. The method of claim 40, further comprising demodulating data on said RF signals received from said RF device.

45. The method of claim 40, further comprising:

receiving a payment indication for parking time at said parking meter; and displaying a purchased time remaining.

46. The method of claim 40, further comprising determining that said RF device is at said parking meter.

47. A method of optical communication from a parking meter comprising:

placing a receiving computing device at a payment interface of said parking meter; and optically receiving at said receiving computing device parking meter related data from said payment interface of said parking meter.

48. The method of claim 47, wherein the receiving computing device comprises an LED for transmitting light and a sensor for receiving light.

49. The method of claim 47, wherein the receiving computing device comprises an infrared transmitter/receiver pair.

50. The method of claim 47, wherein the receiving computing device comprises a circuit board substrate.

51. The method of claim 47, further comprising demodulating said parking meter related data from said parking meter at said receiving computing device.

* * * * *

UNITED STATES PATENT AND TRADEMARK OFFICE

CERTIFICATE OF CORRECTION

PATENT NO. : 8,727,207 B1
APPLICATION NO. : 08/959109
DATED : May 20, 2014
INVENTOR(S) : Church et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 5 years.

Signed and Sealed this
Nineteenth Day of May, 2015

Michelle K. Lee

Michelle K. Lee
*Director of the United States Patent and Trademark Office*